US009904191B1

(12) United States Patent
Saito et al.

(10) Patent No.: US 9,904,191 B1
(45) Date of Patent: Feb. 27, 2018

(54) ELECTROSTATIC CHARGE IMAGE DEVELOPING TONER SET, ELECTROSTATIC CHARGE IMAGE DEVELOPER SET, AND TONER CARTRIDGE SET

(71) Applicant: FUJI XEROX CO., LTD., Tokyo (JP)

(72) Inventors: Yutaka Saito, Kanagawa (JP); Fusako Kiyono, Kanagawa (JP); Hiroki Ohmori, Kanagawa (JP); Yuka Yamagishi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/420,577

(22) Filed: Jan. 31, 2017

(30) Foreign Application Priority Data

Sep. 26, 2016 (JP) ..... 2016-187499

(51) Int. Cl.
*G03G 9/097* (2006.01)
*G03G 9/09* (2006.01)
*G03G 9/087* (2006.01)
*G03G 15/01* (2006.01)

(52) U.S. Cl.
CPC ..... *G03G 9/087* (2013.01); *G03G 15/0121* (2013.01)

(58) Field of Classification Search
CPC . G03G 9/09725; G03G 9/0904; G03G 9/0906
See application file for complete search history.

(56) References Cited

U.S. PATENT DOCUMENTS 9,753,387 B2 * 9/2017 Hasegawa ..... G03G 9/08755
2006/0068306 A1 * 3/2006 Shu ..... G03G 9/091 430/45.51
2009/0011353 A1 * 1/2009 Kaya ..... G03G 9/0902 430/108.4
2009/0035684 A1 * 2/2009 Matsumoto ..... G03G 5/005 430/109.3
2009/0060598 A1 * 3/2009 Kondo ..... G03G 9/0819 399/297
2009/0129795 A1 * 5/2009 Shimmura ..... G03G 15/0126 399/39
2009/0286176 A1 * 11/2009 Ohmura ..... G03G 9/08782 430/107.1
2010/0330488 A1 * 12/2010 Ieda ..... G03G 9/0806 430/108.4
2014/0023967 A1 * 1/2014 Kabata ..... G03G 13/22 430/124.13

FOREIGN PATENT DOCUMENTS

JP 2013-003225 A 1/2013
JP 2014-106517 A 6/2014

* cited by examiner

*Primary Examiner* — Hoa V Le
(74) *Attorney, Agent, or Firm* — Oliff PLC

(57) ABSTRACT

An electrostatic charge image developing toner set includes an electrostatic charge image developing black toner that includes black toner particles including a black colorant, a binder resin, and a release agent, and inorganic particles having an average particle diameter of 50 nm to 300 nm; and an electrostatic charge image developing color toner that includes color toner particles including a color colorant, a binder resin, and a release agent, and inorganic particles having an average particle diameter of 50 nm to 300 nm, wherein a proportion of the release agent exposed to a surface of the color toner particles is greater than a proportion of the release agent exposed to a surface of the black toner particles.

13 Claims, 3 Drawing Sheets

ELECTROSTATIC CHARGE IMAGE DEVELOPING TONER SET, ELECTROSTATIC CHARGE IMAGE DEVELOPER SET, AND TONER CARTRIDGE SET

CROSS-REFERENCE TO RELATED APPLICATIONS

This application is based on and claims priority under 35 USC 119 from Japanese Patent Application No. 2016-187499 filed Sep. 26, 2016.

BACKGROUND

1. Technical Field

The present invention relates to an electrostatic charge image developing toner set, an electrostatic charge image developer set, and a toner cartridge set.

2. Related Art

A method of visualizing image information, such as electrophotography, is currently used in various fields. In electrophotography, an electrostatic charge image is formed on a surface of an image holding member as image information through charging and electrostatic charge image formation. A toner image is developed on the surface of the image holding member using a developer containing a toner, and this toner image is transferred to a recording medium, and then the toner image is fixed to the recording medium. The image information is visualized as an image.

SUMMARY

According to an aspect of the invention, there is provided an electrostatic charge image developing toner set including:

an electrostatic charge image developing black toner that includes black toner particles including a black colorant, a binder resin, and a release agent, and inorganic particles having an average particle diameter of 50 nm to 300 nm; and an electrostatic charge image developing color toner that includes color toner particles including a color colorant, a binder resin, and a release agent, and inorganic particles having an average particle diameter of 50 nm to 300 nm, wherein a proportion of the release agent exposed to a surface of the color toner particles is greater than a proportion of the release agent exposed to a surface of the black toner particles.

BRIEF DESCRIPTION OF THE DRAWINGS

Exemplary embodiments of the present invention will be described in detail based on the following figures, wherein.

DETAILED DESCRIPTION

Figure 1:
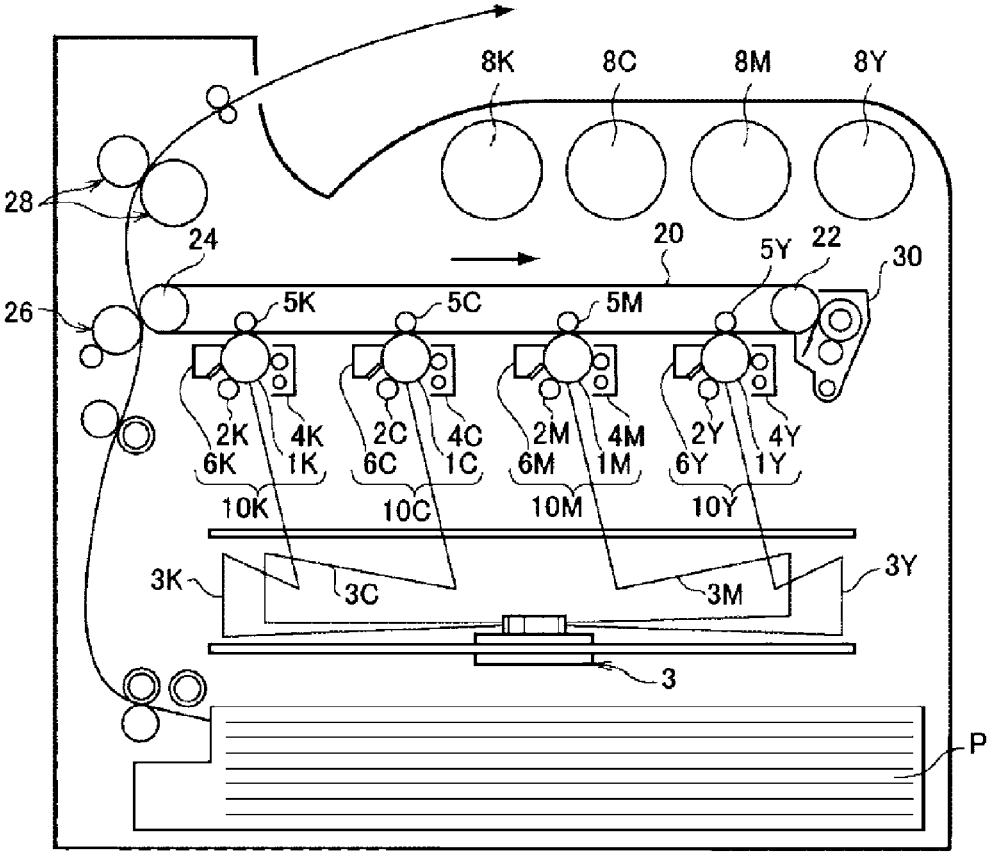
FIG. 1 is a schematic configuration diagram showing an example of an image forming apparatus according to the exemplary embodiment.

Hereinafter, the exemplary embodiments which are an example of the invention will be described in detail.

Electrostatic Charge Image Developing Toner Set

An electrostatic charge image developing toner set according to the exemplary embodiment at least includes an electrostatic charge image developing black toner (black toner) and an electrostatic charge image developing color toner (color toner).

The black toner includes black toner particles including a black colorant, a binder resin, and a release agent, and inorganic particles having an average particle diameter of 50 nm to 300 nm.

The color toner includes color toner particles including a color colorant, a binder resin, and a release agent, and inorganic particles having an average particle diameter of 50 nm to 300 nm.

A proportion of the release agent exposed to the surface of the color toner particles is greater than a proportion of the release agent exposed to the surface of the black toner particles.

Here, the electrostatic charge image developing color toner (color toner), the color toner particles, and the color colorant indicates toners, toner particles, and colorants having colors other than black. Examples of the color toner include a yellow toner, a magenta toner, and a cyan toner.

In the exemplary embodiment, in a case of using toners having plural colors in combination as the color toner (for example, in a case of using toners having three colors such as a yellow toner, a magenta toner, and a cyan toner, in combination), at least any one color toner may satisfy the conditions described above. However, it is preferable that all of the color toners used in combination satisfy the conditions described above.

Hereinafter, in a case of indicating both of the black toner and the color toner, both of the toners is simply referred to as a toner. In addition, in a case of indicating both of the black toner particles and the color toner particles, both of the toner particles are simply referred to as toner particles, in a case of indicating both of the black colorant and the color colorant, both of the colorants are simply referred to as a colorant, and in a case of indicating both of a black image and a color image, both of the images are simply referred to as a toner image.

According to the toner set according to the exemplary embodiment having the configuration described above, excellent reproducibility of fine lines of a black image is obtained, and an image defect such as discoloration occurring when a large amount of images in which black images and color images are present at high image density is formed, is prevented.

A reason of exhibiting these effects is assumed as follows.

It is necessary to provide transferability to a toner used in an image forming apparatus. For example, in a case of an aspect of transferring a toner image formed on a surface of an image holding member to a recording medium through an intermediate transfer member (so-called intermediate transfer system), it is necessary to provide transferability when primarily transferring the toner image from the image holding member to the intermediate transfer member and transferability when secondarily transferring the toner image from the intermediate transfer member to the recording medium. In a case of an aspect of directly transferring a toner image formed on a surface of an image holding member to a recording medium without using an intermediate transfer member (so-called direct transfer system), it is necessary to provide transferability when transferring the toner image from the image holding member to the recording medium.

In the black toner or the color toner, when inorganic particles (external additive having a large diameter) having an average particle diameter of 50 nm to 300 nm are externally added to the toner particles (black toner particles and color toner particles), transferability is applied due to a spacer effect obtained with the external additive having a large diameter.

However, even in a case where the black toner and the color toner in which the external additive having a large diameter are externally added to the toner particles (black toner particles and color toner particles) were used, reproducibility of fine lines of a black image formed using a black toner was deteriorated.

It is thought that this is because of the following reason. That is, in the black toner in which a colorant having comparatively high conductivity such as carbon black is used as a colorant in many cases, resistance thereof is generally lower than that of the color toner. Accordingly, the black toner easily receives charge injection from an electric field applied when transferring a black image, and an electrostatic transferring ability tends to be easily deteriorated, compared to that of the color toner. Thus, it is thought that, in a black image formed using the black toner, transferability of the black toner is deteriorated and as a result, reproducibility of fine lines is deteriorated.

With respect to this, in the exemplary embodiment, the proportion of the release agent exposed to the surface of the black toner particles is controlled to be smaller than the proportion of the release agent exposed to the surface of the color toner particles. When the proportion of the release agent exposed to the surface of the black toner particles is set to be small, an ability to hold the external additive having a large diameter is deteriorated and as a result, an amount of the external additive having a large diameter isolated from the black toner particles increases. When performing the primary transfer of the intermediate transfer system or when performing the transfer of the direct transfer system, the external additive having a large diameter isolated as described above are present between the black toner particles and an image holding member to exhibit a spacer effect, and a deterioration in electrostatic transfer ability is compensated to prevent a deterioration in transferability. Even when performing the secondary transfer of the intermediate transfer system, the isolated external additive having a large diameter are present between the black toner particles and an image holding member to exhibit a spacer effect, and a deterioration in transferability is prevented. As a result, it is assumed that, in a black image formed using the black toner, excellent reproducibility of fine lines is realized.

Meanwhile, in a case where a large amount (for example, 100,000 sheets) of images (for example, images showing a sign of "Keep Out" in which black images and yellow images are alternately formed at high image density) in which black images and color images are present at high image density (for example, with a toner applied amount equal to or greater than 0.7 $g/m^2$) was formed, an image defect such as discoloration that the black toner is mixed with a color image part occurred.

It is thought that this is because of the following reason. That is, in a case where, not only the proportion of the release agent exposed to the surface of the black toner particles, but also the proportion of the release agent exposed to the surface of the color toner particles is controlled to be small to set a state in which there is no difference between the proportions of the release agents exposed to the black toner particles and the color toner particles, an amount of the external additive having a large diameter isolated from the color toner particles also increases, in addition to the amount of the external additive having a large diameter isolated from the black toner particles.

Accordingly, in a case of the intermediate transfer system and in an aspect of including a cleaning blade which cleans a surface of an intermediate transfer member, an amount of the isolated external additive having a large diameter to be accumulated on a contact portion between the intermediate transfer member and the cleaning blade increases. A developing system of including one image holding member and alternately repeating an operation of respectively forming a black image or a color image on the one image holding member and transferring the image (for example, a developing system of, in a case of forming a black image and color images having three colors such as yellow (Y), magenta (M), and cyan (C), repeating an operation of forming an image having one color among four colors on an image holding member and transferring the image, for four colors, which is a so-called single system) has been known. In an image forming apparatus having this single system, in a case of an aspect of providing a cleaning blade which cleans a surface of an image holding member, an amount of the isolated external additive having a large diameter to be accumulated on a contact portion between the image holding member and the cleaning blade increases. When the amount of the isolated external additive having a large diameter to be accumulated increases as described above, abrasion of the cleaning blade for the intermediate transfer member or the cleaning blade for the image holding member is promoted. It is thought that, in a portion where the abrasion occurs, passing of transfer residual toner which is a target of cleaning occurs, and the black toner passed through the cleaning blade is transferred to a color image part to cause an image defect such as discoloration.

With respect to this, in the exemplary embodiment, the proportion of the release agent exposed to the surface of the color toner particles is controlled to be greater than the proportion of the release agent exposed to the surface of the black toner particles. When the proportion of the release agent exposed to the surface of the color toner particles is set to be great, an ability to hold the external additive having a large diameter is improved and as a result, an amount of the external additive having a large diameter isolated from the color toner particles decreases. That is, as described above, the amount of the external additive having a large diameter isolated from the black toner particles increases, whereas the amount of the external additive having a large diameter isolated from the color toner particles decreases. Thus, the amounts of the isolated external additives having a large diameter are offset by both of the increase and the decrease thereof, and accordingly, an increase in the overall amount of the isolated external additives having a large diameter is prevented. Therefore, in an image forming apparatus having an intermediate transfer system, an increase in an amount of the isolated external additive having a large diameter to be accumulated on a cleaning blade for an intermediate transfer member is prevented, or in an image forming apparatus having a single system, an increase in an amount of the isolated external additive having a large diameter to be accumulated on a cleaning blade for an image holding member is prevented, and the progress of abrasion is prevented. As a result, it is assumed that occurrence of the passing of transfer residual toner is reduced and an image defect such as discoloration caused by the mixing of a black toner with a color image part is prevented.

Accordingly, in the exemplary embodiment, excellent reproducibility of fine lines of a black image is obtained and an image defect such as discoloration occurring when a large amount of images in which black images and color images are present at high image density is formed is prevented.

Proportions of Release Agents Exposed as to Color Toner Particles and Black Toner Particles In the exemplary embodiment, the proportion of the release agent exposed to the surface of the color toner particles is greater than the proportion of the release agent exposed to the surface of the black toner particles. That is, a relationship between a proportion of the release agent exposed to the surface of the color toner particles (exposed $\text{proportion}_{[color]}$) and a proportion of the release agent exposed to the surface of the black toner particles (exposed $\text{proportion}_{[black]}$) satisfies the following Expression (EX-1).

$$\text{Exposed proportion}_{[color]}/\text{Exposed proportion}_{[black]}>1 \quad \text{Expression (EX-1):}$$

From a viewpoint of obtaining excellent reproducibility of fine lines of a black image and preventing an image defect such as discoloration, the relationship between the exposed $\text{proportion}_{[color]}$ and the exposed $\text{proportion}_{[black]}$ preferably satisfies the following Expression (EX-2) and more preferably satisfies the following Expression (EX-3).

$$8\geq\text{Exposed proportion}_{[color]}/\text{Exposed proportion}_{[black]}\geq 2 \quad \text{Expression (EX-2):}$$

$$8\geq\text{Exposed proportion}_{[color]}/\text{Exposed proportion}_{[black]}\geq 2 \quad \text{Expression (EX-3):}$$

The proportion of the release agent exposed to the surface of the color toner particles (exposed $\text{proportion}_{[color]}$) is preferably from 0.12% to 10.0%, more preferably from 0.5% to 8.0%, and even more preferably from 3.0% to 7.0%.

When the exposed $\text{proportion}_{[color]}$ is equal to or greater than 0.12%, the occurrence of an image defect such as discoloration is easily prevented. Meanwhile, when the exposed $\text{proportion}_{[color]}$ is equal to or smaller than 10.0%, leakage of charges from a portion to which the release agent is exposed is prevented and density fluctuation due to charge reduction is easily prevented.

The $\text{proportion}_{[black]}$ of the release agent exposed to the surface of the black toner particles is preferably from 0.1% to 3.2%, more preferably from 0.3% to 2.5%, and even more preferably from 0.5% to 2.0%.

When the exposed $\text{proportion}_{[black]}$ is equal to or smaller than 3.2%, excellent reproducibility of fine lines in a black image is easily obtained. Meanwhile, when the exposed $\text{proportion}_{[black]}$ is equal to or greater than 0.1%, leakage of charges from a portion to which the release agent is exposed suitably performed, and accordingly, an excessive increase of charges is prevented and the occurrence of density fluctuation is easily prevented.

Here, the proportion of the release agent exposed to the surface of the color toner particles (exposed $\text{proportion}_{[color]}$) and the proportion of the release agent exposed to the surface of the black toner particles (exposed $\text{proportion}_{[black]}$) are measured using X-ray photoelectron spectroscopy (XPS) by using the toner particles as measurement samples. JPS-9000MX manufactured by JEOL, Ltd. is used as an XPS measurement device. The measurement is performed using MgKα rays as an X-ray source and setting an accelerating voltage as 10 kV and an emission current as 30 mA. Here, the amount of release agent on the surface of the toner particles is determined by a peak separation method of C1s spectrum. In the peak separation method, the measured C1s spectrum is separated for each component using curve fitting performed by a least-square method. For a component spectrum which is the base of the separation, the C1s spectrum obtained by performing single measurement regarding the release agent and the binder resin used in the preparation of the toner particles is used.

An external additive (including inorganic particles) externally added to the toner particles and the toner particles are separated from each other, for example, by dispersing the toner in ion exchange water to which a dispersing agent such as a surfactant is added, and applying ultrasonic waves using an ultrasonic homogenizer (US-300T: NISSEI Corporation). After that, drying and collection are performed through a filtering process and a washing process, to extract only toner particles from which the external additive is separated, and the toner particles are set as measurement samples.

Control Method of Proportions of Release Agents Exposed as to Color Toner Particles and Black Toner Particles In the color toner particles and the black toner particles, a method of controlling the proportions of the release agents exposed to the surfaces thereof is not particularly limited.

As a method of increasing the proportion of the release agents exposed to the surface thereof, the following methods are used, for example.

(1) A method of unevenly distributing the release agent to the surface side of toner particle (2) A method of increasing the amount of release agent included in the toner particle There is a preferable range of the content of the release agent included in the toner particles, from a viewpoint of charging performance of the toner (for example, the content thereof with respect to the total content of the toner particles is preferably 1% by weight to 20% by weight). Accordingly, it is preferable to use the method (1), from a viewpoint of increasing the exposed proportion of the release agent while obtaining the charging performance of the toner, that is, in the exemplary embodiment, it is preferable to increase the proportion of the release agent exposed to the color toner particles using the method (1).

Here, as the (1) method of unevenly distributing the release agent to the surface side of the toner particle, a method of preparing toner particles using a power feed addition method which will be described later, or a method of adjusting a keeping time when resin particles are heated to a temperature equal to or higher than a glass transition temperature in a coalescence process when preparing toner particles using an aggregation and coalescence method which will be described later (as the keeping time becomes longer, the release agent is easily exposed to the surface) is used, for example.

Meanwhile, as a method of decreasing the proportion of the release agent exposed to the surface, the following methods are used, for example.

(i) A method of dispersing the release agent in a state where uniformity is high in the entirety of the toner particle (ii) A method of decreasing the amount of the release agent included in the toner particle (iii) A method of decreasing the amount of the release agent exposed to the surface while unevenly distributing the release agent to a surface portion of the toner particle From a viewpoint of preventing offset (attachment of the toner to a fixing member) to a fixing member when fixing a toner image to a recording medium, it is preferable that the release agent is unevenly distributed to a surface portion of the toner particle, in order to cause bleeding of the release agent at the time of fixing. Accordingly, it is preferable to use the method (iii), from a viewpoint of decreasing the exposed proportion of the release agent while preventing the offset at the time of fixing, that is, in the exemplary embodiment, it is preferable to decrease the proportion of the release agent exposed to the black toner particles using the method (iii).

Here, as the (iii) method of decreasing the amount of the release agent exposed to the surface while unevenly distributing the release agent to a surface portion of the toner particle, a method of preparing toner particles using a power feed addition method which will be described later, unevenly distributing the release agent to the surface side, and then, further forming a shell layer not including the release agent or having a small content of the release agent, or a method of adjusting a keeping time when resin particles are heated to a temperature equal to or higher than a glass transition temperature in a coalescence process when preparing toner particles using an aggregation and coalescence method which will be described later (as the keeping time becomes shorter, the release agent is hardly exposed to the surface) is used, for example.

Domains of Release Agent

The color toner particles and the black toner particles of the exemplary embodiment preferably include domains formed of the release agent on the surfaces thereof, that is, the color toner particles and the black toner particles preferably have a sea-island structure containing a sea part containing a binder resin and an island part containing a release agent.

Here, an average particle diameter of the domains of the release agent (island part containing the release agent) provided on the surface of the color toner particles is preferably from 0.1 μm to 2.0 μm, more preferably from 0.3 μm to 1.8 μm, and even more preferably from 0.5 μm to 1.5 μm.

When the average particle diameter of the domains of the release agent of the color toner particles is equal to or greater than 0.1 μm, the occurrence of an image defect such as discoloration is easily prevented. Meanwhile, when the average particle diameter thereof is equal to or smaller than 2.0 μm, the size of the portion to which the release agent is exposed is not excessively locally increased, the leakage of charges is prevented, and the occurrence of density fluctuation due to charge reduction is easily prevented.

An average particle diameter of the domains of the release agent (island part containing the release agent) provided on the surface of the black toner particles is preferably from 0.1 μm to 2.0 μm, more preferably from 0.3 μm to 1.8 μm, and even more preferably from 0.5 μm to 1.5 μm.

When the average particle diameter of the domains of the release agent of the black toner particles is equal to or smaller than 2.0 μm, excellent reproducibility of fine lines in a black image is easily obtained. Meanwhile, when the average particle diameter thereof is equal to or greater than 0.1 μm, the leakage of charges from a portion to which the release agent is exposed suitably performed, and accordingly, an excessive increase of charges is prevented and the occurrence of density fluctuation is easily prevented.

Here, both of the average particle diameter of the domains of the release agent of the color toner particles and the average particle diameter of the domains of the release agent of the black toner particles are measured by the following method.

Specifically, the measurement is performed by imparting contrast between materials of the release agent and the other portions by using a ruthenium tetroxide staining method based on a difference in degrees of crystallinity, observing the materials with a scanning electron microscope (SEM), taking an image thereof into an image analysis device, and calculating an equivalent circle diameter of the release agent. A specific method of the ruthenium tetroxide staining method is as follows.

Staining

As a sample for electron microscope observation, an aluminum stage for electron microscope observation to which carbon tape is attached is prepared, toner particles (powder) are attached onto the carbon tape. Then, the sample is put into a desiccator together with ruthenium tetroxide (manufactured by Soekawa Chemicals Ltd.) in an environment of a temperature of 25° C. and humidity of 55% to perform an oxidation reaction process for 2 hours, and staining is performed. A degree of staining is determined using a degree of staining of the tape kept in the same manner.

Observation

Using the stained sample for observation, surfaces of stained toner particles are observed using a scanning electron microscope (S-4800 manufactured by Hitachi, Ltd.). When constituent signals at the time of observation are emphasized, components of the binder resin and the release agent on the surface of the toner particles may be determined from a difference in image gray levels. Specifically, an image is observed by setting one particle of the toner is within one viewing field using image analysis software (Win ROOF manufactured by Mitani Corporation), a binarization process is performed to extract a portion of the surface of the toner where the release agent is exposed, and an equivalent circle diameter is calculated. This operation is performed for 100 or more toner particles and an average value thereof is set as an average particle diameter of the domains of the release agent.

Control Method of Average Particle Diameter of Domains of Release Agent

As a method of controlling the average particle diameter of the domains of the release agent provided on the surfaces of the black toner particles and the color toner particles, the following method is used, for example.

A method of adjusting a keeping time when resin particles are heated to a temperature equal to or higher than a glass transition temperature in a coalescence process when preparing toner particles using an aggregation and coalescence method which will be described later (as the keeping time becomes longer, the average particle diameter of the domains of the release agent is easily increased) is used, for example.

Even when a release agent particle dispersion to be used in an aggregation and coalescence method which will be described later is obtained as follows, for example, the average particle diameter of the domains of the release agent may be controlled. First, a mixed solution obtained by mixing a release agent and a dispersing agent (surfactant) with each other is heated to a temperature equal to or higher than a melting point of the release agent, emulsified using a high-pressure type emulsifier, and then, cooled to solidify release agent particles. The centrifugal separation of the prepared release agent particle dispersion is performed using a centrifugal separator, and the particles thereof are divided into release agent particles having a particle diameter equal to or smaller than 2.0 μm and release agent particles having a particle diameter exceeding 2.0 μm, for example. After that, a supernatant formed after the centrifugal separation, that is, a release agent particle dispersion having a particle diameter equal to or smaller than 2.0 μm is collected and provided for a release agent particle dispersion to be used in the aggregation and coalescence method. The conditions are different depending on the type or particle diameter distribution of the release agent, and thus, the conditions are suitably selected. The separation is performed by applying a centrifugal force of 500 G to 1,000 G, for example, as a centrifugal force at the time of the centrifugal separation. When the release agent particle dispersion prepared as described above is used, the average particle diameter of the domains of the release agent is controlled to be equal to or smaller than 2.0 μm.

Hereinafter, the electrostatic charge image developing toner set according to the exemplary embodiment will be described in detail.

The electrostatic charge image developing black toner (black toner) and the electrostatic charge image developing color toner (color toner) included in the toner set according to the exemplary embodiment may employ a configuration freely, except for having different colorants included therein and setting the proportions of the release agent exposed to the surfaces to satisfy the conditions described above. For example, the black toner and the color toner may employ the same configuration, except for the difference in colorants and the difference in the exposed proportions of the release agents.

Hereinafter, constituents of the toners (black toner and color toner) included in the toner set according to the exemplary embodiment will be described.

The toner of the exemplary embodiment includes toner particles and an external additive.

Toner Particles

The toner particles include a binder resin, a colorant, and a release agent, and may further include other additives.

Binder Resin

Examples of the binder resin include vinyl resins formed of homopolymers of monomers such as styrenes (for example, styrene, parachlorostyrene, and α-methylstyrene), (meth)acrylates (for example, methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate), ethylenically unsaturated nitriles (for example, acrylonitrile and methacrylonitrile), vinyl ethers (for example, vinyl methyl ether and vinyl isobutyl ether), vinyl ketones (for example, vinyl methyl ketone, vinyl ethyl ketone, and vinyl isopropenyl ketone), and olefins (for example, ethylene, propylene, and butadiene), or copolymers obtained by combining two or more kinds of these monomers.

Examples of the binder resin also include a non-vinyl resin such as an epoxy resin, a polyester resin, a polyurethane resin, a polyamide resin, a cellulose resin, a polyether resin, and modified rosin, mixtures thereof with the above-described vinyl resin, or graft polymer obtained by polymerizing a vinyl monomer with the coexistence of such non-vinyl resins.

These binder resins may be used singly or in combination of two or more kinds thereof.

As the binder resin, a polyester resin is appropriate.

As the polyester resin, for example, a well-known polyester resin is included.

Examples of the polyester resin include condensation polymers of polyvalent carboxylic acids and polyols. A commercially available product or a synthesized product may be used as the polyester resin.

Examples of the polyvalent carboxylic acid include aliphatic dicarboxylic acids (for example, oxalic acid, malonic acid, maleic acid, fumaric acid, citraconic acid, itaconic acid, glutaconic acid, succinic acid, alkenyl succinic acid, adipic acid, and sebacic acid), alicyclic dicarboxylic acids (for example, cyclohexanedicarboxylic acid), aromatic dicarboxylic acids (for example, terephthalic acid, isophthalic acid, phthalic acid, and naphthalenedicarboxylic acid), anhydrides thereof, or lower alkyl esters (having, for example, from 1 to 5 carbon atoms) thereof. Among these substances, for example, aromatic dicarboxylic acids are preferably used as the polyvalent carboxylic acid.

As the polyvalent carboxylic acid, a tri- or higher-valent carboxylic acid employing a crosslinked structure or a branched structure may be used in combination with a dicarboxylic acid. Examples of the tri- or higher-valent carboxylic acid include trimellitic acid, pyromellitic acid, anhydrides thereof, or lower alkyl esters (having, for example, from 1 to 5 carbon atoms) thereof.

The polyvalent carboxylic acids may be used singly or in combination of two or more types thereof.

Examples of the polyol include aliphatic diols (for example, ethylene glycol, diethylene glycol, triethylene glycol, propylene glycol, butanediol, hexanediol, and neopentyl glycol), alicyclic diols (for example, cyclohexanediol, cyclohexanedimethanol, and hydrogenated bisphenol A), and aromatic diols (for example, ethylene oxide adduct of bisphenol A and propylene oxide adduct of bisphenol A). Among these, for example, aromatic diols and alicyclic diols are preferably used, and aromatic diols are more preferably used as the polyol.

As the polyol, a tri- or higher-valent polyol employing a crosslinked structure or a branched structure may be used in combination together with diol. Examples of the tri- or higher-valent polyol include glycerin, trimethylolpropane, and pentaerythritol.

The polyol may be used singly or in combination of two or more types thereof.

The glass transition temperature (Tg) of the polyester resin is preferably from 50° C. to 80° C., and more preferably from 50° C. to 65° C.

The glass transition temperature is obtained by a DSC curve which is obtained by a differential scanning calorimetry (DSC), and more specifically, is obtained by "Extrapolating Glass Transition Starting Temperature" disclosed in a method for obtaining the glass transition temperature of "Testing Methods for Transition Temperatures of Plastics" in JIS K-7121-1987.

The weight average molecular weight (Mw) of the polyester resin is preferably 5,000 to 1,000,000 and more preferably 7,000 to 500,000.

The number average molecular weight (Mn) of the polyester resin is preferably 2,000 to 100,000.

The molecular weight distribution Mw/Mn of the polyester resin is preferably 1.5 to 100 and more preferably 2 to 60.

The weight average molecular weight and the number average molecular weight are measured by gel permeation chromatography (GPC). The molecular weight measurement by GPC is performed by using GPC•HLC-8120 GPC manufactured by Tosoh Corporation as a measuring device, TSKGEL SUPERHM-M (15 cm) manufactured by Tosoh Corporation, as a column, and a THF solvent. The weight average molecular weight and the number average molecular weight are calculated using a calibration curve of molecular weight obtained with a monodisperse polystyrene standard sample from the measurement results obtained from the measurement.

A well-known preparing method is applied to prepare the polyester resin. Specific examples thereof include a method of conducting a reaction at a polymerization temperature set to 180° C. to 230° C., if necessary, under reduced pressure in the reaction system, while removing water or an alcohol generated during condensation.

In the case in which monomers of the raw materials are not dissolved or compatibilized under a reaction temperature, a high-boiling-point solvent may be added as a solubilizing agent to dissolve the monomers. In this case, a polycondensation reaction is conducted while distilling away the solubilizing agent. In the case in which a monomer having poor compatibility is present in a copolymerization reaction, the monomer having poor compatibility and an acid or an alcohol to be polycondensed with the monomer may be previously condensed and then polycondensed with the main component.

The content of the binder resin is, for example, preferably 40% by weight to 95% by weight, more preferably 50% by weight to 90% by weight, and even more preferably 60% by weight to 85% by weight with respect to a total amount of toner particles.

Colorant

Examples of the colorant include various pigments such as carbon black, chrome yellow, Hansa yellow, benzidine yellow, threne yellow, quinoline yellow, pigment yellow, permanent orange GTR, pyrazolone orange, vulcan orange, watchung red, permanent red, brilliant carmine 3B, brilliant carmine 6B, DuPont oil red, pyrazolone red, lithol red, Rhodamine B Lake, Lake Red C, pigment red, rose bengal, aniline blue, ultramarine blue, calco oil blue, methylene blue chloride, phthalocyanine blue, pigment blue, phthalocyanine green, and malachite green oxalate; and various dyes such as acridine dyes, xanthene dyes, azo dyes, benzoquinone dyes, azine dyes, anthraquinone dyes, thioindigo dyes, dioxadine dyes, thiazine dyes, azomethine dyes, indigo dyes, phthalocyanine dyes, aniline black dyes, polymethine dyes, triphenylmethane dyes, diphenylmethane dyes, and thiazole dyes.

In addition to the carbon black or aniline black dyes, examples of the black colorant include copper oxide, manganese dioxide, activated carbon, nonmagnetic ferrite, and magnetite.

The black colorants exemplified above are colorants having comparatively high conductivity, and accordingly, in the black toner including these black colorants, resistance thereof easily becomes lower than that of the color toner.

The colorants may be used alone or in combination of two or more kinds thereof.

As the colorant, the surface-treated colorant may be used, if necessary. The colorant may be used in combination with a dispersing agent. Plural colorants may be used in combination.

The content of the colorant is, for example, preferably 1% by weight to 30% by weight, more preferably 3% by weight to 15% by weight with respect to a total amount of the toner particles.

Release Agent

Examples of the release agent include hydrocarbon waxes; natural waxes such as carnauba wax, rice wax, and candelilla wax; synthetic or mineral/petroleum waxes such as montan wax; ester waxes such as fatty acid esters and montanic acid esters; and amide wax. The release agent is not limited thereto.

Among the release agents exemplified above, hydrocarbon waxes, fatty acid ester wax, and amide wax are more preferable, from a viewpoint of adjusting the isolation proportion of the external additive having a large diameter (inorganic particles having an average particle diameter of 50 nm to 300 nm), that is, a degree of an effect with respect to attachment between the release agent and the external additive having a large diameter.

The melting temperature of the release agent is preferably 50° C. to 110° C. and more preferably 60° C. to 100° C.

The melting temperature is obtained from "melting peak temperature" described in the method of obtaining a melting temperature in JIS K 7121-1987 "Testing methods for transition temperatures of plastics", from a DSC curve obtained by differential scanning calorimetry (DSC).

The content of the release agent is, for example, preferably 1% by weight to 20% by weight, and more preferably 5% by weight to 15% by weight with respect to the total amount of the toner particles.

Other Additives

Examples of other additives include well-known additives such as a magnetic material, a charge-controlling agent, and an inorganic particle. The toner particles include these additives as internal additives.

Characteristics of Toner Particles

The toner particles may be toner particles having a single-layer structure, or toner particles having a so-called core/shell structure composed of a core (core particle) and a coating layer (shell layer) coated on the core.

Here, the toner particles having a core/shell structure may be configured with, for example, a core including a binder resin, a colorant, and a release agent, and if necessary, other additives, and a coating layer including a binder resin.

The volume average particle diameter (D50v) of the toner particles is preferably 2 μm to 10 μm, and more preferably 4 μm to 8 μm.

Here, when volume average particle diameter (D50v) of the toner particles is equal to or smaller than 5 μm, the external additive having a large diameter which are externally added to the surface is more easily isolated from the toner particles.

The toner set according to the exemplary embodiment is adjusted so that the proportion of the release agent exposed to the surface of the color toner particles is greater than the proportion of the release agent exposed to the surface of the black toner particles as described above. Therefore, the amount of the external additive having a large diameter isolated from the color toner particles is controlled to be decreased while increasing the amount of the external additive having a large diameter isolated from the black toner particles, and as a result, both of the reproducibility of fine lines of a black image and the prevention of an image defect such as discoloration are realized.

It is considered that a difference between the amounts of the external additives having a large diameter isolated from the color toner particles and the black toner particles becomes more significant, when the volume average particle diameter (D50v) of the toner particles is equal to or smaller than 5 μm, and it is thought that the improvement of reproducibility of fine lines and the prevention of discoloration are more effectively exhibited.

Various average particle diameters and various particle size distribution indices of the toner particles are measured by using a COULTER MULTISIZER II (manufactured by Beckman Coulter, Inc.) and ISOTON-II (manufactured by Beckman Coulter, Inc.) as an electrolyte.

In the measurement, from 0.5 mg to 50 mg of a measurement sample is added to 2 ml of a 5% aqueous solution of surfactant (preferably sodium alkylbenzene sulfonate) as a dispersing agent. The obtained material is added to from 100 ml to 150 ml of the electrolyte.

The electrolyte in which the sample is suspended is subjected to a dispersion treatment using an ultrasonic disperser for 1 minute, and a particle size distribution of particles having a particle diameter of from 2 μm to 60 μm is measured by a COULTER MULTISIZER II using an aperture having an aperture diameter of 100 μm. 50,000 particles are sampled.

Cumulative distributions by volume and by number are drawn from the side of the smallest diameter with respect to particle size ranges (channels) separated based on the measured particle size distribution. The particle diameter when the cumulative percentage becomes 16% is defined as that corresponding to a volume average particle diameter D16v and a number average particle diameter D16p, while the particle diameter when the cumulative percentage becomes 50% is defined as that corresponding to a volume average particle diameter D50v and a number average particle diameter D50p. Furthermore, the particle diameter when the cumulative percentage becomes 84% is defined as that corresponding to a volume average particle diameter D84v and a number average particle diameter D84p.

Using these, a volume average particle size distribution index (GSDv) is calculated as $(D84v/D16v)^{1/2}$, while a number average particle size distribution index (GSDp) is calculated as $(D84p/D16p)^{1/2}$.

An average circularity of the toner particles is preferably 0.94 to 1.00 and more preferably 0.95 to 0.98.

The average circularity of the toner particles is determined by an expression of (perimeter of equivalent circle diameter)/(perimeter) [(perimeter of a circle having the same projected area as that of a particle image)/(perimeter of particle projection image)]. Specifically, the average circularity thereof is a value measured using the following method.

First, the toner particles which is a measurement target are sucked and collected, a flat flow is formed, stroboscopic light emission is instantly performed to obtain a particle image as a still image, and the average circularity is determined using a flow-type particle image analysis device (FPIA-2100 manufactured by Sysmex Corporation) which performs image analysis of the particle image. 3,500 particles are sampled when determining the average circularity.

In a case where the toner includes an external additive, the toner (developer) which is a measurement target is dispersed in water including a surfactant, and then, the ultrasonic treatment is performed to obtain toner particles from which the external additive is removed.

External Additive

In the exemplary embodiment, both of the black toner and the color toner include inorganic particles having an average particle diameter of 50 nm to 300 nm (external additive having a large diameter) as an external additive.

External Additive Having Large Diameter Examples of the external additive having a large diameter (inorganic particles) include $SiO_2$ (silica), $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O$—$(TiO_2)$ n, $Al_2O_3.2SiO_2$, $CaCO_3$, $MgCO_3$, $BaSO_4$, and $MgSO_4$.

Among these, silica particles (hereinafter, also referred to as "silica particles having a large diameter") are preferable, from a viewpoint of cleaning properties and a viewpoint of a spacer effect.

The silica particles having a large diameter may be particles using silica, that is, $SiO_2$ as a main component and may be crystalline or amorphous. The silica particles having a large diameter may be particles prepared by using water glass or a silicon compound such as alkoxysilane as a raw material or may be particles obtained by pulverizing quartz.

Specifically, examples of the silica particles having a large diameter include sol-gel silica particles, water colloidal silica particles, alcoholic silica particles, fumed silica particles obtained by a gas phase method, and fused silica particles. Among these, sol-gel silica particles are preferably used.

The silica particles having a large diameter are preferably monodisperse and spherical particles. The monodisperse spherical silica particles are dispersed on the surface of the toner particles substantially in an even state and a spacer effect is obtained.

Here, the monodisperse state may be defined by using standard deviation with respect to an average particle diameter in a case of including an aggregate, and the standard deviation is preferably a value obtained by a volume average particle diameter D50×0.22 or smaller. The spherical shape may be defined by using an average circularity which will be described later.

Average Particle Diameter

The average particle diameter (primary particle diameter) of the silica particles having a large diameter is preferably from 50 nm to 300 nm, more preferably from 70 nm to 280 nm, and even more preferably from 90 nm to 240 nm.

Here, the average particle diameter of the inorganic particles is measured by using the following method.

The primary particles of the inorganic particles are observed by using a scanning electron microscope (SEM) device (S-4100, manufactured by Hitachi, Ltd.) to capture an image, this image is incorporated in an image analysis device (LUZEX III, manufactured by NIRECO Corporation), an area for each particle is measured by the image analysis of the primary particles, and an equivalent circle diameter is calculated from this area value. The calculation of this equivalent circle diameter is performed regarding 100 inorganic particles. A diameter (D50) when cumulative frequency of the obtained based on volume of the obtained equivalent circle diameter becomes 50% is set as an average primary particle diameter (average equivalent circle diameter D50) of the inorganic particles. A magnification of an electron microscope is adjusted so that approximately 10 to 50 inorganic particles are shown in 1 viewing field and an equivalent circle diameter of the primary particles is determined by combining observation of plural viewing fields with each other.

Average Circularity

An average circularity of the external additive having a large diameter is preferably 0.75 to 1.0, more preferably 0.9 to 1.0, and even more preferably 0.92 to 0.98.

Here, the average circularity of the inorganic particles is measured by using the following method.

First, the primary particles of the inorganic particles are observed by using a Scanning Electron Microscope and the circularity thereof is obtained as a value of "100/SF2" calculated by the following expression from the planar image analysis of the obtained primary particles.

$$\text{Circularity}(100/SF2)=4\pi\times(A/I^2) \qquad \text{Expression:}$$

[In the expression, I represents a perimeter of primary particles on an image and A represents a projected area of primary particles]

The average circularity of the inorganic particles is obtained as a circularity when cumulative frequency of circularity of the 100 primary particles obtained by planar image analysis becomes 50%.

The surfaces of the external additive having a large diameter may be treated with a hydrophobizing agent. The hydrophobizing treatment is performed by, for example, dipping the inorganic particles in a hydrophobizing agent. The hydrophobizing agent is not particularly limited and examples thereof include a silane coupling agent, silicone oil, a titanate coupling agent, and an aluminum coupling agent. These may be used alone or in combination of two or more kinds thereof.

Generally, the amount of the hydrophobizing agent is, for example, 1 part by weight to 10 parts by weight with respect to 100 parts by weight of the inorganic particles.

Content

The content of the external additive having a large diameter with respect to the content of the toner particles is preferably 0.5% by weight to 5.0% by weight, more preferably 1.0% by weight to 4.0% by weight, and even more preferably 1.5% by weight to 3.0% by weight, in both of the black toner and the color toner.

When the content of the external additive having a large diameter is equal to or greater than 0.5% by weight, excellent reproducibility of fine lines of a black image is easily obtained.

Meanwhile, when the content of the external additive having a large diameter is equal to or smaller than 5.0% by weight, abrasion of a cleaning unit is easily prevented, in an aspect of including an intermediate transfer member and a cleaning member of the intermediate transfer member.

Other External Additives

In the exemplary embodiment, both of the black toner and the color toner may include external additives (inorganic particles having an average particle diameter smaller than 50 nm (external additive having a small diameter)) other than the external additive having a large diameter.

As the other external additives, inorganic particles are used, for example. Examples of the inorganic particles include $SiO_2$, $TiO_2$, $Al_2O_2$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)$ n, $Al_2O_3.2SiO_2$, $CaCO_3$, $MgCO_3$, $BaSO_4$, and $MgSO_4$.

The surfaces of the other external additives may be treated with a hydrophobizing agent, in the same manner as in the case of the external additive having a large diameter.

Examples of the other external additives also include resin particles (resin particles such as polystyrene, polymethyl methacrylate (PMMA), and melamine resin) and a cleaning aid (for example, a metal salt of higher fatty acid represented by zinc stearate, and fluorine polymer particles).

The amount of the other external additives externally added is, for example, preferably 0.01% by weight to 5% by weight, and more preferably 0.01% by weight to 2.0% by weight with respect to the amount of the toner particles.

Preparing Method of Toner

Next, a preparing method of the toner (black toner and color toner) according to the exemplary embodiment will be described.

The toner according to the exemplary embodiment is obtained by externally adding an external additive to toner particles, if necessary, after preparing the toner particles.

The toner particles may be prepared using any of a dry preparing method (e.g., kneading and pulverizing method) and a wet preparing method (e.g., aggregation and coalescence method, suspension and polymerization method, and dissolution and suspension method). The toner particle preparing method is not particularly limited to these preparing methods, and a known preparing method is employed.

Among these, the toner particles may be obtained by the aggregation and coalescence method.

Particularly, from a viewpoint of obtaining toner particles satisfying a configuration in which the proportion of the release agent exposed to the surface of the color toner particles is greater than the proportion of the release agent exposed to the surface of the black toner particles, the color toner particles and the black toner particles may be prepared by using the aggregation and coalescence method shown below and then, the black toner particles may be controlled so that the amount of the release agent exposed to the surface is decreased.

Next, an aggregation and coalescence method is described below.

Specifically, the toner particle is preferably prepared by processes as follows: a process of preparing each dispersion (dispersion preparation process); a process (first aggregated particle forming process); a process (second aggregated particle forming process); and a process (coalescence process). In the first aggregated particle forming process, particles are aggregated in a dispersion obtained by mixing a first resin particle dispersion and a colorant particle dispersion, and thereby first aggregated particles are formed. The first resin particle dispersion is obtained by dispersing first resin particles corresponding to the binder resin, and the colorant particle dispersion is obtained by dispersing particles of the colorant (also referred to as "colorant particles" below). In the second aggregated particle forming process, a dispersion mixture in which second resin particles corresponding to the binder resin and particles of the release agent (also referred to as "release agent particles" below) are dispersed is prepared. After a first aggregated particle dispersion in which the first aggregated particles are dispersed is prepared, the dispersion mixture is sequentially added to the first aggregated particle dispersion while the concentration of the release agent particles in the dispersion mixture slowly increases. Thus, the second resin particles and the release agent particles are aggregated on a surface of the first aggregated particles, and thereby second aggregated particles are formed. In the coalescence process, a second aggregated particle dispersion in which the second aggregated particles are dispersed is heated to coalesce the second aggregated particles, and thereby toner particles are formed.

The method of preparing the toner particle is not limited to the above descriptions. For example, particles are aggregated in a dispersion mixture obtained by mixing the resin particle dispersion and the colorant particle dispersion. Then, a release agent particle dispersion is added to the dispersion mixture in the process of aggregation while increasing an addition speed slowly or while increasing the concentration of the release agent particles. Thus, aggregation of particles proceeds more, and thereby aggregated particles are formed. The toner particles may be formed by coalescing the aggregated particles.

The processes will be described below in detail.

Preparation Process of Dispersion

First, respective dispersions are prepared by using an aggregation and coalescence method. Specifically, a first resin particle dispersion in which first resin particles corresponding to the binder resin are dispersed, a colorant particle dispersion in which colorant particles are dispersed, a second resin particle dispersion in which second resin particles corresponding to the binder resin are dispersed, and a release agent particle dispersion in which release agent particles are dispersed are prepared.

In the dispersion preparation process, descriptions will be made, referring the first resin particles and the second resin particles to as "resin particles" collectively.

The resin particle dispersion is prepared by, for example, dispersing resin particles in a dispersion medium using a surfactant.

Examples of the dispersion medium used for the resin particle dispersion include aqueous mediums.

Examples of the aqueous mediums include water such as distilled water and ion exchange water, and alcohols. These may be used singly or in combination of two or more kinds thereof.

Examples of the surfactant include anionic surfactants such as a sulfuric ester salt, a sulfonate, a phosphate ester, and a soap; cationic surfactants such as an amine salt and a quaternary ammonium salt; and nonionic surfactants such as polyethylene glycol, an ethylene oxide adduct of alkyl phenol, and polyol. Among these, anionic surfactants and cationic surfactants are particularly preferably used. Nonionic surfactants may be used in combination with anionic surfactants or cationic surfactants.

The surfactants may be used singly or in combination of two or more kinds thereof.

Regarding the resin particle dispersion, as a method of dispersing the resin particles in the dispersion medium, a common dispersing method using, for example, a rotary shearing-type homogenizer, or a ball mill, a sand mill, or a DYNO mill having media is exemplified. Depending on the kind of the resin particles, resin particles may be dispersed in the resin particle dispersion according to, for example, a phase inversion emulsification method.

The phase inversion emulsification method includes: dissolving a resin to be dispersed in a hydrophobic organic solvent in which the resin is soluble; conducting neutralization by adding a base to an organic continuous phase (Ophase); and converting the resin (so-called phase inversion) from W/O to O/W by putting an aqueous medium (W phase) to form a discontinuous phase, thereby dispersing the resin as particles in the aqueous medium.

A volume average particle diameter of the resin particles dispersed in the resin particle dispersion is, for example, preferably from 0.01 μm to 1 μm, more preferably from 0.08 μm to 0.8 μm, and even more preferably from 0.1 μm to 0.6 μm.

Regarding the volume average particle diameter of the resin particles, a cumulative distribution by volume is drawn from the side of the smallest diameter with respect to particle size ranges (channels) separated using the particle size distribution obtained by the measurement with a laser diffraction-type particle size distribution measuring device (for example, LA-700 manufactured by Horiba, Ltd.), and a particle diameter when the cumulative percentage becomes 50% with respect to the entire particles is measured as a volume average particle diameter D50v. The volume average particle diameter of the particles in other dispersions is also measured in the same manner.

The content of the resin particles contained in the resin particle dispersion is, for example, preferably from 5% by weight to 50% by weight, and more preferably from 10% by weight to 40% by weight.

For example, the colorant particle dispersion and the release agent particle dispersion are also prepared in the same manner as in the case of the resin particle dispersion. That is, the particles in the resin particle dispersion are the same as the colorant particles dispersed in the colorant particle dispersion and the release agent particles dispersed in the release agent particle dispersion, in terms of the volume average particle diameter, the dispersion medium, the dispersing method, and the content of the particles.

First Aggregated Particle Forming Process

Next, the first resin particle dispersion and the colorant particle dispersion are mixed together.

The first resin particles and the colorant particles are heterogeneously aggregated in the dispersion mixture, and thereby first aggregated particles including first resin particles and colorant particles are formed.

Specifically, for example, an aggregating agent is added to the dispersion mixture and a pH of the dispersion mixture is adjusted to be acidic (for example, the pH is from 2 to 5). If necessary, a dispersion stabilizer is added. Then, the dispersion mixture is heated at the glass transition temperature of the first resin particles (specifically, for example, from a temperature 30° C. lower than the glass transition temperature of the first resin particles to a temperature 10° C. lower than the glass transition temperature thereof) to aggregate the particles dispersed in the dispersion mixture, and thereby the first aggregated particles are formed.

In the first aggregated particle forming process, for example, the aggregating agent may be added at room temperature (for example, 25° C.) under stirring of the dispersion mixture using a rotary shearing-type homogenizer, the pH of the dispersion mixture may be adjusted to be acidic (for example, the pH is from 2 to 5), a dispersion stabilizer may be added if necessary, and then the heating may be performed.

Examples of the aggregating agent include a surfactant having an opposite polarity to the polarity of the surfactant used as the dispersing agent to be added to the mixed dispersion, an inorganic metal salt, and a bi- or higher-valent metal complex. Particularly, when a metal complex is used as the aggregating agent, the amount of the surfactant used is reduced and charging characteristics are improved.

If necessary, an additive may be used which forms a complex or a similar bond with the metal ions of the aggregating agent. A chelating agent is preferably used as the additive.

Examples of the inorganic metal salt include a metal salt such as calcium chloride, calcium nitrate, barium chloride, magnesium chloride, zinc chloride, aluminum chloride, and aluminum sulfate, and inorganic metal salt polymer such as polyaluminum chloride, polyaluminum hydroxide, and calcium polysulfide.

A water-soluble chelating agent may be used as the chelating agent. Examples of the chelating agent include oxycarboxylic acids such as tartaric acid, citric acid, and gluconic acid, iminodiacetic acid (IDA), nitrilotriacetic acid (NTA), and ethylenediaminetetraacetic acid (EDTA).

An addition amount of the chelating agent is, for example, preferably in a range of from 0.01 parts by weight to 5.0 parts by weight, and more preferably in a range of from 0.1 parts by weight to less than 3.0 parts by weight relative to 100 parts by weight of the first resin particles.

Second Aggregated Particle Forming Process

Next, after the first aggregated particle dispersion in which the first aggregated particles are dispersed is obtained, a dispersion mixture in which the second resin particles and the release agent particles are dispersed is sequentially added to the first aggregated particle dispersion while increasing the concentration of the release agent particles in the dispersion mixture slowly.

The second resin particles may be the same type as or a different type from the first resin particles.

The second resin particles and the release agent particles are aggregated on surfaces of the first aggregated particles in a dispersion in which the first aggregated particles, the second resin particles, and the release agent particles are dispersed. Specifically, for example, in the first aggregated particle forming process, when a particle diameter of the first aggregated particle reaches a desired particle diameter, a dispersion mixture in which the second resin particles and the release agent particles are dispersed is added to the first aggregated particle dispersion while increasing the concentration of the release agent particles slowly. The dispersion is heated at a temperature which is equal to or less than the glass transition temperature of the second resin particles.

For example, the pH of the dispersion is substantially in a range of from 6.5 to 8.5, and thus the progress of the aggregation is stopped.

Aggregated particles in which the second resin particles and the release agent particles are attached to the surfaces of the first aggregated particles are formed through this process. That is, second aggregated particles in which aggregates of the second resin particles and the release agent particles are attached to the surfaces of the first aggregated particles are formed. At this time, since the dispersion mixture in which the second resin particles and the release agent particles are dispersed is sequentially added to the first aggregated particle dispersion while increasing the concentration of the release agent particles in the dispersion mixture slowly, the concentration (abundance ratio) of the release agent particles becomes slowly larger toward the radially outside direction of the particles, and the aggregates of the second resin particles and the release agent particles are attached to the surface of the first aggregated particle.

As a method of adding the dispersion mixture, a power feeding addition method may preferably be used. The dispersion mixture may be added to the first aggregated particle dispersion, with a gradual increase of the concentration of the release agent particles in the dispersion mixture, by using the power feeding addition method.

The method of adding the dispersion mixture using the power feeding addition method will be described with reference to the drawing.

Figure 3:
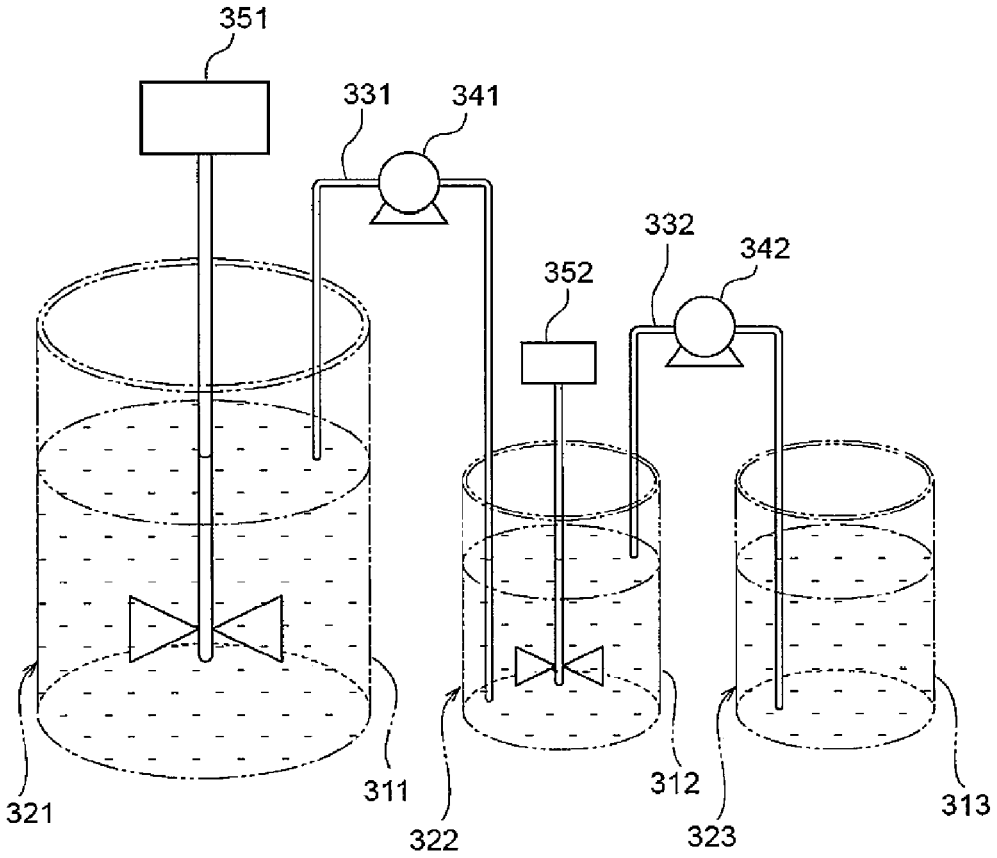
FIG. 3 is a schematic view for explaining a power feed addition method.

FIG. 3 illustrates an apparatus used in the power feeding addition method. In FIG. 3, the reference numeral 311 indicates the first aggregated particle dispersion, the reference numeral 312 indicates the second resin particle dispersion, the reference numeral 313 indicates the release agent particle dispersion.

The apparatus illustrated in FIG. 3 includes a first storage tank 321, a second storage tank 322, and a third storage tank 323. In the first storage tank 321, the first aggregated particle dispersion in which the first aggregated particles are dispersed is stored. In the second storage tank 322, the second resin particle dispersion in which the second resin particles are dispersed is stored. In the third storage tank 323, the release agent particle dispersion in which the release agent particles are dispersed is stored.

The first storage tank 321 and the second storage tank 322 are linked to each other by using a first liquid transport tube 331. A first liquid transport pump 341 is provided in the middle of a path of the first liquid transport tube 331. Driving of the first liquid transport pump 341 causes the dispersion stored in the second storage tank 322 to be transported to the dispersion stored in the first storage tank 321 through the first liquid transport tube 331.

A first stirring apparatus 351 is disposed in the first storage tank 321. When driving of the first stirring apparatus 351 causes the dispersion stored in the second storage tank 322 to be transported to the dispersion stored in the first storage tank 321, the dispersions in the first storage tank 321 are stirred and mixed.

The second storage tank 322 and the third storage tank 323 are linked to each other by using a second liquid transport tube 332. A second liquid transport pump 342 is provided in the middle of a path of the second liquid transport tube 332. Driving of the second liquid transport pump 342 causes the dispersion stored in the third storage tank 323 to be transported to the dispersion stored in the second storage tank 322 through the second liquid transport tube 332.

A second stirring apparatus 352 is disposed in the second storage tank 322. When driving of the second stirring apparatus 352 causes the dispersion stored in the third storage tank 323 to be transported to the dispersion stored in the second storage tank 322, the dispersions in the second storage tank 322 are stirred and mixed.

In the apparatus illustrated in FIG. 3, first, the first aggregated particle forming process is performed and thereby a first aggregated particle dispersion is prepared, in the first storage tank 321. The first aggregated particle dispersion is stored in the first storage tank 321. The first aggregated particle forming process may be performed and thereby the first aggregated particle dispersion may be prepared in another tank, and then, the first aggregated particle dispersion may be stored in the first storage tank 321.

In this state, the first liquid transport pump 341 and the second liquid transport pump 342 are driven. This driving causes the second resin particle dispersion stored in the second storage tank 322 to be transported to the first aggregated particle dispersion stored in the first storage tank 321. Driving of the first stirring apparatus 351 causes the dispersions in the first storage tank 321 to be stirred and mixed.

The release agent particle dispersion stored in the third storage tank 323 is transported to the second resin particle dispersion stored in the second storage tank 322. Driving of the second stirring apparatus 352 causes the dispersions in the second storage tank 322 to be stirred and mixed.

At this time, the release agent particle dispersion is sequentially transported to the second resin particle dispersion stored in the second storage tank 322, and thus the concentration of the release agent particles becomes higher slowly. For this reason, the dispersion mixture in which second resin particles and the release agent particles are dispersed is stored in the second storage tank 322, and this dispersion mixture is transported to the first aggregated particle dispersion stored in the first storage tank 321. The dispersion mixture is continuously transported with an increase of the concentration of the release agent particle dispersion in the dispersion mixture.

In this manner, the dispersion mixture in which the second resin particles and the release agent particles are dispersed may be added to the first aggregated particle dispersion with a gradual increase of the concentration of the release agent particles, by using the power feeding addition method.

In the power feeding addition method, the degree of uneven distribution of the release agent in the toner particle is adjusted by adjusting liquid transport starting time and a liquid transport speed for each of the dispersions which are respectively stored in the second storage tank 322 and the third storage tank 323. In the power feeding addition method, also by adjusting the liquid transport speed in the process of transporting of the dispersions respectively stored in the second storage tank 322 and the third storage tank 323, the degree of uneven distribution of the release agent in the toner particle is adjusted.

The above-described power feeding addition method is not limited to the above method. For example, various methods may be employed. Examples of the various methods include a method in which, a storage tank storing the second resin particle dispersion and a storage tank storing a dispersion mixture in which the second resin particles and the release agent particles are dispersed are separately provided and the respective dispersions are transported to the first storage tank 321 from the respective storage tanks while changing the liquid transport speed, a method in which a storage tank storing the release agent particle dispersion and a storage tank storing a dispersion mixture in which the second resin particles and the release agent particles are dispersed are separately provided, and the respective dispersions are transported to the first storage tank 321 from the respective storage tanks while changing the liquid transport speed, and the like.

As described above, the second aggregated particles in which the second resin particles and the release agent particles are attached to the surfaces of the first aggregated particles and aggregated are obtained.

Coalescence Process

Next, the second aggregated particle dispersion in which the second aggregated particles are dispersed is heated at, for example, a temperature that is equal to or higher than the glass transition temperature of the first and second resin particles (for example, a temperature that is higher than the glass transition temperature of the first and second resin particles by 10° C. to 30° C.) to coalesce the second aggregated particles.

When toner particles are prepared as described above, the proportion of the release agent exposed to the surface may be increased. Accordingly, in the exemplary embodiment, it is preferable to prepare the color toner particles used in the color toner as described above. As the keeping time when heating the resin particles to a temperature equal to or higher than the glass transition temperature, after obtaining the second aggregated particles becomes longer, the release agent is easily exposed to the surface.

After the second aggregated particle dispersion in which the second aggregated particles are dispersed is obtained, toner particles may be prepared through the processes of: further mixing the second aggregated particle dispersion with a third resin particle dispersion in which third resin particles which is a binder resin are dispersed to conduct aggregation so that the third resin particles further adhere to the surfaces of the second aggregated particles, thereby forming third aggregated particles; and coalescing the second aggregated particles by heating the third aggregated particle dispersion in which the third aggregated particles are dispersed, thereby forming toner particles having a core/shell structure.

As described above, when a shell layer formed of a binder resin (or having a small content of the release agent) is further formed on the surface of the second aggregated particles, the proportion of the release agent exposed to the surface may be decreased. Accordingly, in the exemplary embodiment, it is preferable to prepare the black toner particles used in the black toner as described above. As the keeping time when heating the resin particles to a temperature equal to or higher than the glass transition temperature, after obtaining the third aggregated particles becomes shorter, the release agent is hardly exposed to the surface.

When the black toner particles and the color toner particles are prepared as described above, the toner particles may satisfy the configuration in which the proportion of the release agent exposed to the surface of the color toner particles is greater than the proportion of the release agent exposed to the surface of the black toner particles.

After the coalescence process ends, the toner particles formed in the solution are subjected to a washing process, a solid-liquid separation process, and a drying process, that are well known, and thus dry toner particles are obtained.

In the washing process, preferably, displacement washing using ion exchange water is sufficiently performed from the viewpoint of charging properties. In addition, the solid-liquid separation process is not particularly limited, and suction filtration, pressure filtration, or the like may be performed from the viewpoint of productivity. The method for the drying process is also not particularly limited, and freeze drying, flush drying, fluidized drying, vibration-type fluidized drying, or the like may be performed from a viewpoint of productivity.

The toner according to the exemplary embodiment is prepared by adding an external additive including at least an external additive having a large diameter (inorganic particles having an average particle diameter of 50 nm to 300 nm) to the obtained dry toner particles and mixing the materials. The mixing may be performed by using a V blender, a HENSCHEL MIXER, a Lodige mixer, and the like. Further, if necessary, coarse toner particles may be removed by using a vibration classifier, a wind classifier, and the like.

Electrostatic Charge Image Developer Set

An electrostatic charge image developer set according to the exemplary embodiment includes at least the toner set according to the exemplary embodiment.

The electrostatic charge image developer set according to the exemplary embodiment may be a single-component developer including only the toner of the toner set according to the exemplary embodiment or may be a two-component developer obtained by mixing the toner and a carrier.

The carrier is not particularly limited and known carriers are exemplified. Examples of the carrier include a coating carrier in which surfaces of cores formed of magnetic particles are coated with a coating resin; a magnetic particle dispersion-type carrier in which magnetic particles are dispersed and blended in a matrix resin; and a resin impregnation-type carrier in which porous magnetic particles are impregnated with a resin.

The magnetic particle dispersion-type carrier and the resin impregnation-type carrier may be carriers in which constituent particles of the carrier are cores and coated with a coating resin.

Examples of the magnetic particles include magnetic metals such as iron, nickel, and cobalt, and magnetic oxides such as ferrite and magnetite.

Examples of the resin for coating and matrix resin include polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene-acrylic acid ester copolymer, a straight silicone resin configured to include an organosiloxane bond or a modified product thereof, a fluororesin, polyester, polycarbonate, a phenol resin, and an epoxy resin.

The coating resin and the matrix resin may contain other additives such as conductive materials.

Examples of the conductive particles include particles of metals such as gold, silver, and copper, carbon black particles, titanium oxide particles, zinc oxide particles, tin oxide particles, barium sulfate particles, aluminum borate particles, and potassium titanate particles.

Here, a coating method using a coating layer forming solution in which a coating resin, and if necessary, various additives are dissolved in an appropriate solvent is used to coat the surface of a core with the coating resin. The solvent is not particularly limited, and may be selected in consideration of the coating resin to be used, coating suitability, and the like.

Specific examples of the resin coating method include a dipping method of dipping cores in a coating layer forming solution, a spraying method of spraying a coating layer forming solution to surfaces of cores, a fluid bed method of spraying a coating layer forming solution in a state in which cores are allowed to float by flowing air, and a kneader-coater method in which cores of a carrier and a coating layer forming solution are mixed with each other in a kneader-coater and the solvent is removed.

The mixing ratio (weight ratio) between the toner and the carrier in the two-component developer is preferably 1:100 to 30:100, and more preferably 3:100 to 20:100 (toner: carrier).

Image Forming Apparatus and Image Forming Method

An image forming apparatus and an image forming method according to the exemplary embodiment will be described.

The image forming apparatus according to the exemplary embodiment includes a first image forming unit that forms a black image using the electrostatic charge image developing black toner of the electrostatic charge image developing toner set according to the exemplary embodiment, a second image forming unit that forms a color image using the electrostatic charge image developing color toner of the electrostatic charge image developing toner set according to the exemplary embodiment, a transfer unit that transfers the black image and the color image onto a recording medium, and a fixing unit that fixes the black image and the color image onto the recording medium.

The image forming apparatus according to the exemplary embodiment may include each image forming unit including an image holding member, a charging unit that charges a surface of the image holding member, an electrostatic charge image forming unit that forms an electrostatic charge image on the charged surface of the image holding member, a developing unit that develops the electrostatic charge image formed on the surface of the image holding member with the electrostatic charge image developer as a toner image, as the first or second image forming unit.

In addition, the image forming apparatus according to the exemplary embodiment may include an image holding member, a charging unit that charges a surface of the image holding member, an electrostatic charge image forming unit that forms an electrostatic charge image on the charged surface of the image holding member, and, as the first or second image forming unit, a first and second developing units that develop the electrostatic charge image formed on the surface of the image holding member with the electrostatic charge image developer as a toner image.

In the image forming apparatus according to the exemplary embodiment, an image forming method (image forming method according to the exemplary embodiment) including a first image forming step of forming a black image using the electrostatic charge image developing black toner of the electrostatic charge image developing toner set according to the exemplary embodiment, a second image forming step of forming a color image using the electrostatic charge image developing color toner of the electrostatic charge image developing toner set according to the exemplary embodiment, a transfer step of transferring the black image and the color image onto a recording medium, and a fixing step of fixing the black image and the color image onto the recording medium, is performed.

As the image forming apparatus according to the exemplary embodiment, a known image forming apparatus is applied, such as a direct transfer type apparatus that directly transfers a toner image (in the exemplary embodiment, black image and color image) formed on a surface of an image holding member onto a recording medium; an intermediate transfer type apparatus that primarily transfers a toner image formed on a surface of an image holding member onto a surface of an intermediate transfer member, and secondarily transfers the toner image transferred to the surface of the intermediate transfer member onto a surface of a recording medium; or an apparatus that is provided with a cleaning unit that cleans the surface of the image holding member before charging, after transferring the toner image; or an apparatus that is provided with an erasing unit that irradiates, after transfer of a toner image, a surface of an image holding member with erase light before charging for erasing.

In a case of an intermediate transfer type apparatus, a transfer unit is configured to have, for example, an intermediate transfer member having a surface to which a toner image is to be transferred, a primary transfer unit that primarily transfers a toner image formed on a surface of an image holding member onto the surface of the intermediate transfer member, and a secondary transfer unit that secondarily transfers the toner image transferred onto the surface of the intermediate transfer member onto a surface of a recording medium.

In the image forming apparatus according to the exemplary embodiment, for example, a part including the developing unit may have a cartridge structure (process cartridge) that is detachable from the image forming apparatus. As the process cartridge, for example, a process cartridge that includes a container that contains the electrostatic charge image developer set according to the exemplary embodiment and is provided with a developing unit is suitably used.

Isolation Proportion of External Additive Having Large Diameter of Black Toner and Color Toner In the exemplary embodiment, a relationship between an isolation proportion$_{[black]}$ (%) represented by the following Expression (1b) in the black toner in a black image before being transferred onto a recording medium and an isolation proportion$_{[color]}$ (%) represented by the following Expression (1c) in the color toner in a color image before being transferred onto a recording medium preferably satisfies the following Expression (2).

$$\text{isolation proportion}_{[black]}=Xb_{[sep]}/(Xb_{[sep]}+Xb_{[sti]})\times 100 \quad \text{Expression (1b)}$$

$$\text{isolation proportion}_{[color]}=Xc_{[sep]}/(Xc_{[sep]}+Xc_{[sti]})\times 100 \quad \text{Expression (1c)}$$

(In Expression (1b), $Xb_{[sep]}$ represents an amount of the inorganic particles having an average particle diameter of 50 nm to 300 nm which are isolated from the surface of the black toner particles and $Xb_{[sti]}$ represents an amount of the inorganic particles having an average particle diameter of 50 nm to 300 nm which are attached to the surface of the black toner particles.

In Expression (1c), $Xc_{[sep]}$ represents an amount of the inorganic particles having an average particle diameter of 50 nm to 300 nm which are isolated from the surface of the color toner particles and $Xc_{[sti]}$ represents an amount of the inorganic particles having an average particle diameter of 50 nm to 300 nm which are attached to the surface of the color toner particles.)

$$8 \geq \text{isolation proportion}_{[black]}/\text{isolation proportion}_{[color]} \geq 2 \quad \text{Expression (2)}$$

When a relationship of isolation "8≥isolation proportion$_{[black]}$/isolation proportion$_{[color]}$≥2" is satisfied, excellent reproducibility of fine lines of a black image is obtained, and an image defect such as discoloration occurring when a large amount of images in which black images and color images are present at high image density is formed, is prevented.

The isolation proportion$_{[black]}$ and the isolation proportion$_{[color]}$ preferably satisfies the following Expression (2-1) and more preferably satisfies the following Expression (2-2).

$$7 \geq \text{isolation proportion}_{[black]}/\text{isolation proportion}_{[color]} \geq 3 \quad \text{Expression (2-1)}$$

$$6 \geq \text{isolation proportion}_{[black]}/\text{isolation proportion}_{[color]} \geq 4 \quad \text{Expression (2-2)}$$

Measurement Method of Isolation Proportion of External Additive Having Large Diameter Here, a measurement method of the isolation proportion$_{[black]}$ (%) in the black toner in a black image before being transferred onto a recording medium and the isolation proportion$_{[color]}$ (%) in the color toner in a color image before being transferred onto a recording medium will be described.

First, the black toner and the color toner are respectively collected from a black image and a color image (specifically, which are formed on a surface of an image holding member) before being transferred onto a recording medium. Next, 100 ml of ion exchange water and 5.5 ml of an aqueous solution of 10% by weight TRITON X-100 (manufactured by ACROS Organics) are added to 200 ml of a glass bottle, 5 g of a toner (black toner or the color toner) is added to the mixed solution, the mixed solution is stirred 30 times and kept for 1 hour or longer.

Then, the mixed solution is stirred 20 times, a dial is set to the output of 30% by using an ultrasonic homogenizer (product name: homogenizer, type VCX750, CV33 manufactured by Sonics & Materials, Inc.) and ultrasonic energy is applied for 1 minute under the following conditions.

Vibration time: successively 60 seconds

Amplitude: set to 20 W (30%)

Vibration start temperature: 23±1.5° C.

Distance between ultrasonic vibrator and bottom surface of vessel: 10 mm

Then, the mixed solution that has received the ultrasonic energy is subjected to filtration by using filter paper (product name: QUALITATIVE FILTERS PAPERS (No. 2, 110 mm) manufactured by Toyo Roshi Kaisha, Ltd.), washed two times using ion exchange water, the isolated external additive having a large diameter is filtered and removed, and the toner is dried.

The amount of external additive having a large diameter remaining in the toner after removing the external additive having a large diameter by the above process (hereinafter, referred to as the amount of external additive having a large diameter after dispersion) and the amount of external additive having a large diameter of the toner which is not subjected to the process of removing the external additive having a large diameter (hereinafter, referred to as the amount of external additive having a large diameter before dispersion) are quantified by a fluorescence X-ray method, and values of the amount of external additive having a large diameter before dispersion and the amount of external additive having a large diameter after dispersion are substituted in the following expression.

The value calculated by the following expression is set as the isolation proportion of the external additive having a large diameter.

isolation proportion of the external additive having a large diameter (%)=[(amount of external additive having a large diameter before dispersion−amount of external additive having a large diameter after dispersion)/amount of external additive having a large diameter before dispersion]×100 Expression:

Hereinafter, an example of the image forming apparatus according to the exemplary embodiment will be shown. However, the image forming apparatus is not limited thereto. Main portions shown in the drawing will be described, but descriptions of other portions will be omitted.

FIG. 1 is a schematic configuration diagram showing the image forming apparatus according to the exemplary embodiment.

The image forming apparatus shown in FIG. 1 is provided with first to fourth electrophotographic image forming units 10Y, 10M, 10C, and 10K (image forming units) that output yellow (Y), magenta (M), cyan (C), and black (K) images based on color-separated image data, respectively. These image forming units (hereinafter, may be simply referred to as "units") 10Y, 10M, 10C, and 10K are arranged side by side at predetermined intervals in a horizontal direction. These units 10Y, 10M, 10C, and 10K may be process cartridges that are detachable from the image forming apparatus.

An intermediate transfer belt 20 as an intermediate transfer member is installed above the units 10Y, 10M, 10C, and 10K in the drawing to extend through the units. The intermediate transfer belt 20 is wound on a driving roll 22 and a support roll 24 contacting the inner surface of the intermediate transfer belt 20, which are disposed to be separated from each other on the left and right sides in the drawing, and travels in a direction toward the fourth unit 10K from the first unit 10Y. The support roll 24 is pressed in a direction in which it departs from the driving roll 22 by a spring or the like (not shown), and a tension is given to the intermediate transfer belt 20 wound on both of the rolls. In addition, an intermediate transfer member cleaning device 30 opposed to the driving roll 22 is provided on a surface of the intermediate transfer belt 20 on the image holding member side.

Developing devices (developing units) 4Y, 4M, 4C, and 4K of the units 10Y, 10M, 10C, and 10K are supplied with toner including four color toner, that is, a yellow toner, a magenta toner, a cyan toner, and a black toner accommodated in toner cartridges 8Y, 8M, 8C, and 8K, respectively.

The first to fourth units 10Y, 10M, 10C, and 10K have the same configuration, and accordingly, only the first unit 10Y that is disposed on the upstream side in a traveling direction of the intermediate transfer belt to form a yellow image will be representatively described here. The same parts as in the first unit 10Y will be denoted by the reference numerals with magenta (M), cyan (C), and black (K) added instead of yellow (Y), and descriptions of the second to fourth units 10M, 10C, and 10K will be omitted.

The first unit 10Y has a photoreceptor 1Y acting as an image holding member. Around the photoreceptor 1Y, a charging roll (an example of the charging unit) 2Y that charges a surface of the photoreceptor 1Y to a predetermined potential, an exposure device (an example of the electrostatic charge image forming unit) 3 that exposes the charged surface with laser beams 3Y based on a color-separated image signal to form an electrostatic charge image, a developing device (an example of the developing unit) 4Y that supplies a charged toner to the electrostatic charge image to develop the electrostatic charge image, a primary transfer roll (an example of the primary transfer unit) 5Y that transfers the developed toner image onto the intermediate transfer belt 20, and a photoreceptor cleaning device (an example of the cleaning unit) 6Y that removes the toner remaining on the surface of the photoreceptor 1Y after primary transfer, are arranged in sequence.

The primary transfer roll 5Y is disposed inside the intermediate transfer belt 20 to be provided at a position opposed to the photoreceptor 1Y. Furthermore, bias supplies (not shown) that apply a primary transfer bias are connected to the primary transfer rolls 5Y, 5M, 5C, and 5K, respectively. Each bias supply changes a transfer bias that is applied to each primary transfer roll under the control of a controller (not shown).

Hereinafter, an operation of forming a yellow image in the first unit 10Y will be described.

First, before the operation, the surface of the photoreceptor 1Y is charged to a potential of −600 V to −800 V by the charging roll 2Y.

The photoreceptor 1Y is formed by laminating a photosensitive layer on a conductive substrate (for example, volume resistivity at 20° C.: $1\times10^{-6}$ Ωcm or less). The photosensitive layer typically has high resistance (that is about the same as the resistance of a general resin), but has properties in which when laser beams 3Y are applied, the specific resistance of a part irradiated with the laser beams changes. Accordingly, the laser beams 3Y are output to the charged surface of the photoreceptor 1Y via the exposure device 3 in accordance with image data for yellow sent from the controller (not shown). The laser beams 3Y are applied to the photosensitive layer on the surface of the photoreceptor 1Y, so that an electrostatic charge image of a yellow image pattern is formed on the surface of the photoreceptor 1Y.

The electrostatic charge image is an image that is formed on the surface of the photoreceptor 1Y by charging, and is a so-called negative latent image, that is formed by irradiating the photosensitive layer with laser beams 3Y so that the specific resistance of the irradiated part is lowered to cause charges to flow on the surface of the photoreceptor 1Y, while charges stay on a part which is not irradiated with the laser beams 3Y.

The electrostatic charge image formed on the photoreceptor 1Y is rotated up to a predetermined developing position with the travelling of the photoreceptor 1Y. The electrostatic charge image on the photoreceptor 1Y is visualized (developed) as a toner image at the developing position by the developing device 4Y.

The developing device 4Y accommodates, for example, an electrostatic charge image developer including at least a yellow toner and a carrier. The yellow toner is frictionally charged by being stirred in the developing device 4Y to have a charge with the same polarity (negative polarity) as the charge that is on the photoreceptor 1Y, and is thus held on the developer roll (an example of the developer holding member). By allowing the surface of the photoreceptor 1Y to pass through the developing device 4Y, the yellow toner electrostatically adheres to the erased latent image part on the surface of the photoreceptor 1Y, so that the latent image is developed with the yellow toner. Next, the photoreceptor 1Y having the yellow toner image formed thereon continuously travels at a predetermined rate and the toner image developed on the photoreceptor 1Y is transported to a predetermined primary transfer position.

When the yellow toner image on the photoreceptor 1Y is transported to the primary transfer position, a primary transfer bias is applied to the primary transfer roll 5Y and an electrostatic force toward the primary transfer roll 5Y from the photoreceptor 1Y acts on the toner image, so that the toner image on the photoreceptor 1Y is transferred onto the intermediate transfer belt 20. The transfer bias applied at this time has the opposite polarity (+) to the toner polarity (−), and, for example, is controlled to +10 μA in the first unit 10Y by the controller (not shown).

On the other hand, the toner remaining on the photoreceptor 1Y is removed and collected by the photoreceptor cleaning device 6Y.

The primary transfer biases that are applied to the primary transfer rolls 5M, 5C, and 5K of the second unit 10M and the subsequent units are also controlled in the same manner as in the case of the first unit.

In this manner, the intermediate transfer belt 20 onto which the yellow toner image is transferred in the first unit 10Y is sequentially transported through the second to fourth units 10M, 10C, and 10K, and the toner images of respective colors are multiply-transferred in a superimposed manner.

The intermediate transfer belt 20 onto which the four color toner images have been multiply-transferred through the first to fourth units reaches a secondary transfer part that is composed of the intermediate transfer belt 20, the support roll 24 contacting the inner surface of the intermediate transfer belt, and a secondary transfer roll (an example of the secondary transfer unit) 26 disposed on the image holding surface side of the intermediate transfer belt 20. Meanwhile, a recording sheet (an example of the recording medium) P is supplied to a gap between the secondary transfer roll 26 and the intermediate transfer belt 20, that contact with each other, via a supply mechanism at a predetermined timing, and a secondary transfer bias is applied to the support roll 24. The transfer bias applied at this time has the same polarity (−) as the toner polarity (−), and an electrostatic force toward the recording sheet P from the intermediate transfer belt 20 acts on the toner image, so that the toner image on the intermediate transfer belt 20 is transferred onto the recording sheet P. In this case, the secondary transfer bias is determined depending on the resistance detected by a resistance detector (not shown) that detects the resistance of the secondary transfer part, and is voltage-controlled.

Thereafter, the recording sheet P is fed to a pressure-contacting part (nip part) between a pair of fixing rolls in a fixing device (an example of the fixing unit) 28 so that the toner image is fixed to the recording sheet P, so that a fixed image is formed.

Examples of the recording sheet P onto which a toner image is transferred include plain paper that is used in electrophotographic copying machines, printers, and the like. As a recording medium, an OHP sheet is also exemplified other than the recording sheet P.

The surface of the recording sheet P is preferably smooth in order to further improve smoothness of the image surface after fixing. For example, coated paper obtained by coating a surface of plain paper with a resin or the like, art paper for printing, and the like are preferably used.

The recording sheet P on which the fixing of the color image is completed is transported toward a discharge part, and a series of the color image forming operations ends.

Process Cartridge/Toner Cartridge Set

A process cartridge according to the exemplary embodiment will be described.

The process cartridge according to the exemplary embodiment includes a first developing unit that includes a container that contains a black electrostatic charge image developer of the electrostatic charge image developer set according to the exemplary embodiment, and a second developing unit that includes a container that contains a color electrostatic charge image developer of the electrostatic charge image developer set according to the exemplary embodiment, and is detachable from an image forming apparatus.

The process cartridge according to the exemplary embodiment is not limited to the above-described configuration, and may be configured to include a developing device, and if necessary, at least one selected from other units such as an image holding member, a charging unit, an electrostatic charge image forming unit, and a transfer unit.

Hereinafter, an example of the process cartridge according to the exemplary embodiment will be shown. However, this process cartridge is not limited thereto. Major parts shown in the drawing will be described, but descriptions of other parts will be omitted.

Figure 2:
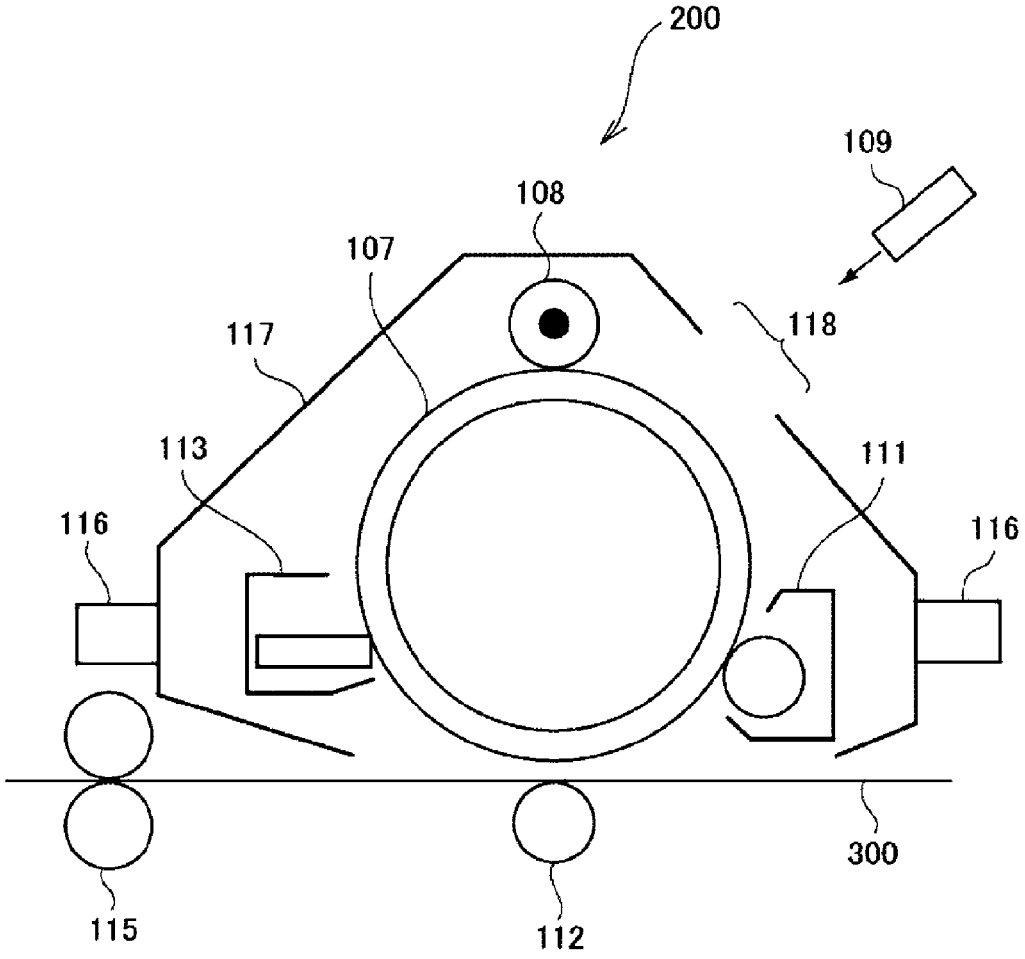
FIG. 2 is a schematic configuration diagram showing an example of a process cartridge according to the exemplary embodiment.

FIG. 2 is a schematic configuration diagram showing the process cartridge according to the exemplary embodiment.

A process cartridge 200 shown in FIG. 2 is formed as a cartridge having a configuration in which a photoreceptor 107 (an example of the image holding member), a charging roll 108 (an example of the charging unit), a developing device 111 (an example of the developing unit), and a photoreceptor cleaning device 113 (an example of the cleaning unit), which are provided around the photoreceptor 107, are integrally combined and held by the use of, for example, a housing 117 provided with a mounting rail 116 and an opening 118 for exposure.

In FIG. 2, the reference numeral 109 represents an exposure device (an example of the electrostatic charge image forming unit), the reference numeral 112 represents a transfer device (an example of the transfer unit), the reference numeral 115 represents a fixing device (an example of the fixing unit), and the reference numeral 300 represents a recording sheet (an example of the recording medium).

Next, a toner cartridge set according to the exemplary embodiment will be described.

The toner cartridge set according to the exemplary embodiment includes a black toner cartridge that includes a container that contains the black toner included in the toner set according to the exemplary embodiment and is detachable from an image forming apparatus, and a color toner cartridge that includes a container that contains the color toner included in the toner set according to the exemplary embodiment and is detachable from an image forming apparatus. The toner cartridge set includes a container that contains a toner for replenishment for being supplied to the developing unit provided in the image forming apparatus.

The image forming apparatus shown in FIG. 1 has such a configuration that the toner cartridges 8Y, 8M, 8C, and 8K are detachable therefrom, and the developing devices 4Y, 4M, 4C, and 4K are connected to the toner cartridges corresponding to the respective developing devices (colors) via toner supply tubes (not shown), respectively. In addition, in a case where the toner accommodated in the toner cartridge runs low, the toner cartridge is replaced.

EXAMPLES

Hereinafter, the exemplary embodiment of the invention will be described in detail using examples and comparative examples, but the exemplary embodiment of the invention is not limited to the examples. In the following descriptions, "parts" are based on weight, unless specifically noted.

Preparation of Resin Particle Dispersion

Preparation of Resin Particle Dispersion (1)

Terephthalic acid: 30 parts by mol

Fumaric acid: 70 parts by mol

Bisphenol A ethylene oxide adduct: 5 parts by mol

Bisphenol A propylene oxide adduct: 95 parts by mol

The above components are put in a 5-liter flask provided with a stirrer, a nitrogen gas introducing tube, a temperature sensor, and a rectifying column. Then, the temperature is increased to 210° C. over 1 hour, and 1 part of titanium tetraethoxide is added to 100 parts of the above material. The temperature is increased to 230° C. over 0.5 hours while distilling away generated water, a dehydration condensation reaction is continued at this temperature for 1 hour, and then the reactant is cooled. Thus, a polyester resin (1) having a weight average molecular weight of 18,500, an acid value of 14 mgKOH/g, and a glass transition temperature of 59° C. is synthesized.

40 parts of ethyl acetate and 25 parts of 2-butanol are added into a vessel provided with a temperature adjustment unit and a nitrogen substitution unit to prepare a mixed solution, 100 parts of the polyester resin (1) is slowly added and dissolved in the mixed solution, and 10% by weight ammonia aqueous solution (equivalent to the amount of three times the acid value of the resin by a molar ratio) is added thereto and stirred for 30 minutes.

Then, the atmosphere in the vessel is substituted into dry nitrogen, the temperature is kept at 40° C., and 400 parts of ion exchange water is added thereto dropwise at a rate of 2 part/min, while stirring the mixed solution, to perform emulsification. After performing dropwise adding, the temperature of the emulsified solution is returned to room temperature (20° C. to 25° C.), bubbling is performed for 48 hours by dry nitrogen while stirring, to decrease the content of ethyl acetate and 2-butanol to be equal to or smaller than 1,000 ppm, and thus, a resin particle dispersion in which resin particles having a volume average particle diameter of 200 nm are dispersed is obtained. Ion exchange water is added to the resin particle dispersion to adjust solid component amount to 20% by weight, thereby obtaining a resin particle dispersion (1).

Preparation of Colorant Particle Dispersion

Preparation of Yellow Colorant Dispersion (Y1)

Yellow pigment C.I. PY 74 (Hansa Yellow 5GX01 manufactured by Clariant): 70 parts Anionic surfactant (NEOGEN RK manufactured by DKS Co., Ltd.): 1 parts Ion exchange water: 200 parts The above materials are mixed with each other, and dispersed for 10 minutes by using a homogenizer (ULTRA TURRAX T50 manufactured by IKA Works, Inc.). Ion exchange water is added so that a solid content in the dispersion becomes 20% by weight, and thus, a colorant dispersion (Y1) in which colorant particles having a volume average particle diameter of 190 nm are dispersed is obtained.

Preparation of Black Colorant Dispersion (K1)

Black pigment carbon black (NIPEX manufactured by Orion engineered carbon): 70 parts Anionic surfactant (NEOGEN RK manufactured by DKS Co., Ltd.): 1 part Ion exchange water: 200 parts The above materials are mixed with each other, and dispersed for 10 minutes by using a homogenizer (ULTRA TURRAX T50 manufactured by IKA Works, Inc.). Ion exchange water is added so that a solid content in the dispersion becomes 20% by weight, and thus, a colorant dispersion (K1) in which colorant particles having a volume average particle diameter of 190 nm are dispersed is obtained.

Preparation of Release Agent Particle Dispersion

Preparation of Release Agent Particle Dispersion (1)

Paraffin Wax (HNP-9 manufactured by Nippon Seiro Co., Ltd.): 100 parts

Anionic surfactant (NEOGEN RK manufactured by DKS Co., Ltd.): 1 part

Ion exchange water: 350 parts

The above materials are mixed with each other, heated to 100° C., and dispersed using a homogenizer (ULTRA TURRAX T50 manufactured by IKA Works, Inc.). After that, the mixture is subject to dispersion treatment with MANTON-GAULIN HIGH PRESSURE HOMOGENIZER (manufactured by Gaulin Co., Ltd.), and thus, a release agent particle dispersion (1) (solid content of 20% by weight) in which release agent particles having a volume average particle diameter of 200 nm are dispersed is obtained.

Preparation of Silica Particles

Preparation of Silica Particles 1

$SiCl_4$, hydrogen gas, and oxygen gas are mixed with each other in a mixing chamber of a combustion burner, and combust at a temperature of 1,000° C. to 3,000° C. Silica powder is taken out from gas after the combustion to obtain silica particles. At this time, a molar ratio of hydrogen gas and oxygen gas is set as 1.7:1, and thus, silica particles (R1) having a volume average particle diameter of 136 nm are obtained. 100 parts of the obtained silica particles (R1) and 500 parts of ethanol are put into an evaporator and stirred for 15 minutes while maintaining the temperature at 40° C. Then, 20 parts of hexamethyldisilazane (HMDS) is put into 100 parts of the obtained silica particles (R1) and stirred for 15 minutes. Finally, the temperature is increased to 90° C. and ethanol is removed under the reduced pressure. After that, the treated product is taken out and further subjected to vacuum drying at 120° C. for 30 minutes, and thus, silica particles 1 having a volume average particle diameter of 60 nm, which are treated with hexamethyldisilazane, are obtained.

Preparation of Silica Particles 2

Silica particles 2 having a volume average particle diameter of 150 nm are obtained according to the same conditions and method as in the case of the silica particles 1, except for setting the molar ratio between hydrogen gas and oxygen gas as 1.1:1.

Preparation of Silica Particles 3

Silica particles 3 having a volume average particle diameter of 280 nm are obtained according to the same conditions and method as in the case of the silica particles 1, except for setting the molar ratio between hydrogen gas and oxygen gas as 1.00:1.

Preparation of Silica Particles 4

Silica particles 4 having a volume average particle diameter of 40 nm are obtained according to the same conditions and method as in the case of the silica particles 1, except for setting the molar ratio between hydrogen gas and oxygen gas as 2.0:1.

Preparation of Silica Particles 5

Silica particles 5 having a volume average particle diameter of 330 nm are obtained according to the same conditions and method as in the case of the silica particles 1, except for setting the molar ratio between hydrogen gas and oxygen gas as 0.8:1.

Preparation of Developer

Preparation of Yellow Toner Particles (Y1)

An apparatus (see FIG. 3) is prepared, in which a round stainless steel flask and a vessel A are connected to each other through a tube pump A, a solution contained in the vessel A is transmitted to the flask by the driving of the tube pump A, the vessel A and a vessel B are connected to each other through a tube pump B, and a solution contained in the vessel B is transmitted to the vessel A by the driving of the tube pump B. The following operations are performed using this apparatus.

Resin particle dispersion (1): 500 parts

Yellow colorant dispersion (Y1): 40 parts

Anionic surfactant (TaycaPower): 2 parts

The above materials are put into the round stainless steel flask, 0.1 N of nitric acid is added thereto to adjust the pH to 3.5, and then, 30 parts of a nitric acid aqueous solution having polyaluminum chloride concentration of 10% by weight is added. Then, the resultant material is dispersed at 30° C. using a homogenizer (ULTRA TURRAX T50 manufactured by IKA Works, Inc.) and the temperature is increased at a rate of 1° C./30 min in a heating oil bath to increase a particle diameter of aggregated particles.

Meanwhile, 150 parts of the resin particle dispersion (1) is put into the vessel A being a polyester bottle and 25 parts of the release agent particle dispersion (1) is put into the vessel B in the same manner. Then, a solution transmission rate of the tube pump A is set as 0.70 part/1 min, a solution transmission rate of the tube pump B is set as 0.14 part/1 min, the tube pump A and the tube pump B are driven when a temperature in the round stainless steel flask during the formation of aggregating particles reaches 37.0° C., so that transmission of each dispersion is started. Accordingly, a mixed dispersion in which the resin particles and the release agent particles are dispersed is transmitted from the vessel A to the round stainless steel flask in which the aggregated particles are being formed, while slowly increasing concentration of the release agent particles.

The resultant material is kept for 30 minutes after the transmission of each dispersion to the flask is completed and the temperature in the flask becomes 48° C., and thus, the second aggregated particles are formed.

After adjusting the pH to 8.5 by adding 0.1 N sodium hydroxide aqueous solution to a dispersion in which the second aggregated particles are dispersed, and the temperature is increased to 85° C. while stirring, followed by keeping for 5 hours (keeping time). Then, the temperature is decreased to 20° C. at a rate of 20° C./min, the resultant material is filtered, sufficiently washed with ion exchange water, and dried, to obtain yellow toner particles (Y1).

Preparation of Black Toner Particles (K1)

Resin particle dispersion (1): 500 parts

Black colorant dispersion (K1): 40 parts

Anionic surfactant (TaycaPower): 2 parts

The same apparatus as the apparatus used in the preparation of the yellow toner particles (Y1) is prepared. The above materials are put into the round stainless steel flask, 0.1 N of nitric acid is added thereto to adjust the pH to 3.5, and then, 30 parts of a nitric acid aqueous solution having polyaluminum chloride concentration of 10% by weight is added. Then, the resultant material is dispersed at 30° C. using a homogenizer (ULTRA TURRAX T50 manufactured by IKA Works, Inc.) and the temperature is increased at a rate of 1° C./30 min in a heating oil bath to increase a particle diameter of aggregated particles.

Meanwhile, 150 parts of the resin particle dispersion (1) is put into the vessel A being a polyester bottle and 25 parts of the release agent particle dispersion (1) is put into the vessel B in the same manner. Then, a solution transmission rate of the tube pump A is set as 0.70 part/1 min, a solution transmission rate of the tube pump B is set as 0.14 part/1 min, the tube pump A and the tube pump B are driven when a temperature in the round stainless steel flask during the formation of aggregating particles reaches 37.0° C. so that transmission of each dispersion is started. Accordingly, a mixed dispersion in which the resin particles and the release agent particles are dispersed is transmitted from the vessel A to the round stainless steel flask in which the aggregated particles are being formed, while slowly increasing concentration of the release agent particles.

The resultant material is kept for 30 minutes after the transmission of each dispersion to the flask is completed and the temperature in the flask becomes 48° C., and thus, the second aggregated particles are formed.

After that, 50 parts of resin particle dispersion (1) is slowly added thereto and kept for 1 hour, and the third aggregated particles are formed. After adjusting the pH to 8.5 by adding 0.1 N sodium hydroxide aqueous solution to a dispersion in which the third aggregated particles are dispersed, the temperature is increased to 85° C. while stirring, and the resultant is kept for 5 hours. Then, the temperature is decreased to 20° C. at a rate of 20° C./min, the resultant material is filtered, sufficiently washed with ion exchange water, and dried, to obtain black toner particles (K1).

Preparation of Toner 100 parts of the yellow toner particles (Y1) or the black toner particles (K1) and 3.0 parts of the silica particles 1 (volume average particle diameter of 60 nm) as the external additive having a large diameter are mixed with each other in a HENSCHEL MIXER (rate of 30 m/sec for 3 minutes), and a yellow toner (Y1) and a black toner (K1) are obtained.

Preparation of Developer

Ferrite particles (average particle diameter of 50 μm): 100 parts

Toluene: 14 parts

A styrene-methyl methacrylate copolymer: (copolymerization ratio: 15/85): 3 parts Carbon black: 0.2 parts The above components except for the ferrite particles are dispersed by a sand mill to prepare a dispersion, this dispersion and the ferrite particles are put into a vacuum degassing type kneader, dried while stirring under the reduced pressure, and thus, a carrier is obtained.

8 parts of the yellow toner (Y1) or the black toner (K1) is mixed with 100 parts of the carrier, and thus, a yellow developer (Y1) or a black developer (K1) is obtained.

Yellow Toner Particles (Y2)

Yellow toner particles (Y2) are prepared in the same manner as in the preparation of the yellow toner particles (Y1), except for changing the keeping time, after forming the second aggregated particles, adding sodium hydroxide aqueous solution to the dispersion thereof and increasing the temperature to 85° C., to 12 hours.

Yellow Toner Particles (Y3)

Yellow toner particles (Y3) are prepared in the same manner as in the preparation of the yellow toner particles (Y1), except for changing the keeping time after forming the second aggregated particles, adding sodium hydroxide aqueous solution to the dispersion thereof and increasing the temperature to 85° C. to 8 hours.

Yellow Toner Particles (Y4)

Yellow toner particles (Y4) are prepared in the same manner as in the preparation of the yellow toner particles (Y1), except for changing the keeping time, after forming the second aggregated particles, adding sodium hydroxide aqueous solution to the dispersion thereof and increasing the temperature to 85° C., to 3 hours.

Yellow Toner Particles (Y5)

Yellow toner particles (Y5) are prepared in the same manner as in the preparation of the yellow toner particles (Y1), except for changing the keeping time, after forming the second aggregated particles, adding sodium hydroxide aqueous solution to the dispersion thereof and increasing the temperature to 85° C., to 7 hours.

Yellow Toner Particles (Y6)

Yellow toner particles (Y6) are prepared in the same manner as in the preparation of the yellow toner particles (Y1), except for changing the keeping time, after forming the second aggregated particles, adding sodium hydroxide aqueous solution to the dispersion thereof and increasing the temperature to 85° C., to 6 hours.

Black Toner Particles (K2)

Black toner particles (K2) are prepared in the same manner as in the preparation of the black toner particles (K1), except for changing the keeping time, after forming the third aggregated particles, adding sodium hydroxide aqueous solution to the dispersion thereof and increasing the temperature to 85° C., to 9 hours.

Black Toner Particles (K3)

Black toner particles (K3) are prepared in the same manner as in the preparation of the black toner particles (K1), except for changing the keeping time, after forming the third aggregated particles, adding sodium hydroxide aqueous solution to the dispersion thereof and increasing the temperature to 85° C., to 7 hours.

Examples 1 to 9 and Comparative Examples 1 to 5

A black developer and a yellow developer are prepared by combining the components disclosed in the following Table 1 as the black toner particles, the yellow toner particles, and the silica particles.

Various Measurements

A "toner volume average particle diameter", a "proportion of release agent exposed to surface", and an "average particle diameter of domains of release agent" regarding the black toner particles and the yellow toner particles obtained in the examples are measured according to the methods described above.

The image forming is stopped during an evaluation test regarding discoloration described below, the black toner in a black image and the yellow toner in a yellow image loaded on an image holding member (photoreceptor) are collected, and "isolation proportion of silica" thereof is measured according to the methods described above.

Evaluation

Reproducibility of Fine Lines

The evaluation regarding the reproducibility of fine lines is performed as follows.

"700 Digital Color Press" manufactured by Fuji Xerox Co., Ltd. is prepared and a developing device thereof is filled with the black developer and the yellow developer obtained in each of the examples and the comparative examples. The developing device is kept in an environment at 5° C. and 20% RH for 12 hours, and then, a 1%-printed chart is printed on 100,000 A4-sized sheets in the same environment. In the initial stage (tenth sheet), after printing the 1,000-th sheet, the 10,000-th sheet, the 50,000-th sheet, the 100,000-th sheet, and after the apparatus is kept for 72 hours after printing the 100,000-th sheet, 1on1off images (image in which 1 dot lines are disposed in parallel at 1 dot intervals) having a resolution of 2,400 dpi are printed on an upper left portion, the center, and a lower right portion of an A4-sized sheet, as a chart having a size of 5 cm×5 cm in a direction orthogonal to a developing direction. Regarding spaces between fine lines of each chart printed on the printed samples, presence or absence of portions where the space is narrowed due to scattering of the toner or portions where the space is widened due to thinning of the fine lines is observed using a magnifier with ×100 magnification. A grade evaluation is performed based on the following criteria from the result of the above observation and spaces between fine lines of the observed portions.

Evaluation Criteria

G1: in a case where there is no decrease in size of the spaces between fine lines due to the scattering or increase in size of the spaces between fine lines due to the thinning of fine lines, regarding all of the charts G2: in a case where a decrease or an increase in size of the spaces between fine lines is observed, but the number of charts in which the fine lines may be confirmed, is at least one G3: in a case where the spaces between fine lines may not be determined or the number of charts in which deletion of the fine lines is observed is at least one G4: in a case where the spaces between fine lines may not be determined or the number of charts in which deletion of the fine lines is observed is two or more Discoloration The evaluation regarding discoloration is performed as follows.

"700 Digital Color Press" manufactured by Fuji Xerox Co., Ltd. is prepared as an intermediate transfer type image forming apparatus, and a developing device thereof is filled with the black developer and the yellow developer obtained in each of the examples and the comparative examples. The image forming apparatus includes a cleaning blade which is disposed as a cleaning device for an intermediate transfer belt according to a doctor system.

One sheet of an image showing a sign of "Keep Out" in which yellow images having high image density (toner applied amount of 1.0 g/m$^2$) and black images having high image density (toner applied amount of 1.0 g/m$^2$) are alternately repeated is printed using the image forming apparatus, and this sheet is designated as a "sample 1". Then, 100,000 sheets of the same image are printed and the last image is designated as a "sample 2".

The color gamut (L*,a*,b*) of the samples 1 and 2 is measured and ΔE is calculated from a difference in color gamut between the sample 1 and the sample 2 according to the following expressions.

$$\Delta E=[(\Delta L^*)^2+(\Delta a^*)^2+(\Delta b^*)^2]^{1/2}$$

$$\Delta L^*=(L^*\text{of sample 2})-(L^*\text{of sample 1})$$

$$\Delta a^*=(a^*\text{of sample 2})-(a^*\text{of sample 1})$$

$$\Delta b^*=(b^*\text{of sample 2})-(b^*\text{of sample 1})$$

The above is evaluated based on the following evaluation criteria.

Evaluation Criteria $G1$: $\Delta E \leq 2.0$ $G2$: $2.0<\Delta E \leq 4.0$ $G3$: $4.0<\Delta E \leq 6.0$ $G4$: $6.0<\Delta E \leq 10$ $G5$: $10<\Delta E$

TABLE 1

| | | Black toner particles | | | | Yellow toner particles | | | | |
|---|---|---|---|---|---|---|---|---|---|---|
| | | Type | Toner particle diameter [nm] | Proportion of release agent exposed [%] | Diameter of domains of release agent [nm] | Type | Toner particle diameter [nm] | Proportion of release agent exposed [%] | Diameter of domains of release agent [nm] | Silica particle diameter [nm] |
| Examples | 1 | K1 | 6.1 | 0.34 | 0.3 | Y1 | 6.2 | 0.82 | 0.4 | 60 |
| | 2 | K1 | 6.1 | 0.34 | 0.3 | Y2 | 5.6 | 9.26 | 1.9 | 60 |
| | 3 | K2 | 5.8 | 2.92 | 1.8 | Y3 | 5.8 | 3.64 | 1.1 | 60 |
| | 4 | K2 | 5.8 | 2.92 | 1.8 | Y2 | 5.6 | 9.26 | 1.9 | 60 |
| | 5 | K1 | 6.1 | 0.34 | 0.3 | Y2 | 5.6 | 9.26 | 1.9 | 150 |
| | 6 | K2 | 5.8 | 2.92 | 1.8 | Y3 | 5.8 | 3.64 | 1.1 | 150 |
| | 7 | K2 | 5.8 | 2.92 | 1.8 | Y2 | 5.6 | 9.26 | 1.9 | 150 |
| | 8 | K2 | 5.8 | 2.92 | 1.8 | Y3 | 5.8 | 3.64 | 1.1 | 280 |
| | 9 | K2 | 5.8 | 2.92 | 1.8 | Y2 | 5.6 | 9.26 | 1.9 | 280 |
| Comparative Examples | 1 | K1 | 6.1 | 0.34 | 0.3 | Y4 | 6.4 | 0.24 | 0.2 | 150 |
| | 2 | K2 | 5.8 | 2.92 | 1.8 | Y5 | 5.9 | 2.42 | 0.9 | 150 |
| | 3 | K3 | 5.9 | 1.82 | 1.0 | Y6 | 6.0 | 1.64 | 0.6 | 150 |
| | 4 | K2 | 5.8 | 2.92 | 1.8 | Y2 | 5.6 | 9.26 | 1.9 | 40 |
| | 5 | K2 | 5.8 | 2.92 | 1.8 | Y2 | 5.6 | 9.26 | 1.9 | 330 |

The silica particles shown in Table 1 are as follows.

Silica particles 1 (volume average particle diameter: 60 nm)

Silica particles 2 (volume average particle diameter: 150 nm)

Silica particles 3 (volume average particle diameter: 280 nm)

Silica particles 4 (volume average particle diameter: 40 nm)

Silica particles 5 (volume average particle diameter: 330 nm)

TABLE 2

| | | Isolation proportion of silica on photoreceptor (%) | | Evaluation | |
|---|---|---|---|---|---|
| | | Black toner | Yellow toner | Reproducibility of fine lines | Discoloration |
| Examples | 1 | 12.7 | 4.2 | G2 | G2 |
| | 2 | 12.7 | 2.0 | G2 | G2 |
| | 3 | 6.2 | 2.8 | G3 | G1 |
| | 4 | 6.2 | 2.0 | G3 | G1 |
| | 5 | 16.5 | 3.3 | G1 | G3 |

TABLE 2-continued

| | | Isolation proportion of silica on photoreceptor (%) | | Evaluation | |
|---|---|---|---|---|---|
| | | Black toner | Yellow toner | Reproducibility of fine lines | Discoloration |
| | 6 | 12.6 | 4.8 | G1 | G3 |
| | 7 | 12.6 | 3.3 | G1 | G2 |
| | 8 | 14.2 | 5.6 | G1 | G3 |
| | 9 | 14.2 | 4.4 | G1 | G3 |
| Comparative Examples | 1 | 17.2 | 12.4 | G1 | G5 |
| | 2 | 12.6 | 7.8 | G1 | G4 |
| | 3 | 10.4 | 9.7 | G1 | G4 |
| | 4 | 6.0 | 0.7 | G4 | G1 |
| | 5 | 18.1 | 9.3 | G1 | G5 |

From the above results, it is found that, in the exemplary embodiment, excellent reproducibility of fine lines of a black image is obtained, and an image defect such as discoloration, which is liable to occur when an image having a black image and a color image are present at a high image density is formed in a large amount, is prevented, as compared with the comparative examples.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic charge image developing toner set comprising:

an electrostatic charge image developing black toner that includes black toner particles including a black colorant, a binder resin, and a release agent, and inorganic particles having an average particle diameter of 50 nm to 300 nm; and an electrostatic charge image developing color toner that includes color toner particles including a color colorant, a binder resin, and a release agent, and inorganic particles having an average particle diameter of 50 nm to 300 nm, wherein a proportion of the release agent exposed to a surface of the color toner particles is greater than a proportion of the release agent exposed to a surface of the black toner particles.

2. The electrostatic charge image developing toner set according to claim 1, wherein a relationship between the proportion of the release agent exposed to a surface of the color toner particles (exposed proportion$_{[color]}$) and the proportion of the release agent exposed to a surface of the black toner particles (exposed proportion$_{[black]}$) satisfies the following expression:

$$8 \geq \text{exposed proportion}_{[color]}/\text{exposed proportion}_{[black]} \geq 2.$$

3. The electrostatic charge image developing toner set according to claim 1, wherein the release agent included in the black toner particle is unevenly distributed to a surface portion of the black toner particle.

4. The electrostatic charge image developing toner set according to claim 1, wherein the proportion of the release agent exposed to a surface of the color toner particles is from 0.12% to 10.0%, and the proportion of the release agent exposed to a surface of the black toner particles is from 0.1% to 3.2%.

5. The electrostatic charge image developing toner set according to claim 1, wherein the color toner particle and the black toner particle each includes domains formed of the release agent on the surface, and the domains have an average particle diameter of 0.1 μm to 2.0 μm.

6. The electrostatic charge image developing toner set according to claim 1, wherein the inorganic particles included in the electrostatic charge image developing color toner and the inorganic particles included in the electrostatic charge image developing black toner each are silica particles.

7. The electrostatic charge image developing toner set according to claim 6, wherein the silica particles are sol-gel silica particles.

8. The electrostatic charge image developing toner set according to claim 1, wherein an average circularity of the inorganic particles having an average particle diameter of 50 nm to 300 nm is from 0.92 to 0.98.

9. The electrostatic charge image developing toner set according to claim 1, wherein a volume average particle diameter of the electrostatic charge image developing color toner and a volume average particle diameter of the electrostatic charge image developing black toner each is from 2.0 μm to 10.0 μm.

10. The electrostatic charge image developing toner set according to claim 1, wherein the binder resin included in the color toner particles and the binder resin included in the black toner particles each is a polyester resin having a glass transition temperature (Tg) of 50° C. to 80° C., and the release agent included in the color toner particles and the release agent included in the black toner particles each has a melting temperature of 60° C. to 100° C.

11. The electrostatic charge image developing toner set according to claim 1, wherein an average circularity of the electrostatic charge image developing color toner and an average circularity of the electrostatic charge image developing black toner each is from 0.95 to 0.98.

12. An electrostatic charge image developer set comprising:

a black electrostatic charge image developer including the electrostatic charge image developing black toner included in the electrostatic charge image developing toner set according to claim 1; and a color electrostatic charge image developer including the electrostatic charge image developing color toner included in the electrostatic charge image developing toner set according to claim 1.

13. A toner cartridge set comprising:

a black toner cartridge that includes a container that contains the electrostatic charge image developing black toner included in the electrostatic charge image developing toner set according to claim 1, and is detachable from an image forming apparatus; and a color toner cartridge that includes a container that contains the electrostatic charge image developing color toner included in the electrostatic charge image developing toner set according to claim 1, and is detachable from an image forming apparatus.

* * * * *